US010881260B2

(12) United States Patent
Larson et al.

(10) Patent No.: US 10,881,260 B2
(45) **Date of Patent: *Jan. 5, 2021**

(54) SURFACE MAINTENANCE MACHINE WITH A QUICK ALIGNMENT MECHANISM FOR A CLEANING TOOL

(71) Applicant: Tennant Company, Minneapolis, MN (US)

(72) Inventors: Warren L. Larson, Maple Grove, MN (US); Kevin R. Williams, Andover, MN (US); Adam J. C. Runnoe, Minneapolis, MN (US); Ronald W. Lehman, Maple Grove, MN (US)

(73) Assignee: Tennant Company, Minneapolis, MN (US)

( * ) Notice: Subject to any disclaimer, the term of this patent is extended or adjusted under 35 U.S.C. 154(b) by 331 days.

This patent is subject to a terminal disclaimer.

(21) Appl. No.: 16/129,043

(22) Filed: Sep. 12, 2018

(65) Prior Publication Data

US 2019/0069750 A1 Mar. 7, 2019

Related U.S. Application Data

(63) Continuation of application No. 15/158,111, filed on May 18, 2016, now Pat. No. 10,092,158.

(Continued)

(51) Int. Cl.

*A47L 11/40* (2006.01)
*A47L 11/24* (2006.01)

(Continued)

(52) U.S. Cl.

CPC ..... *A47L 11/4038* (2013.01); *A47L 11/24* (2013.01); *A47L 11/283* (2013.01);

(Continued)

(58) Field of Classification Search

CPC .... A47L 11/4038; A47L 11/24; A47L 11/283; A47L 11/4055; A47L 11/4069; E01H 1/053

(Continued)

(56) References Cited

U.S. PATENT DOCUMENTS 3,407,422 A * 10/1968 Otto ..... A47L 11/4069 15/49.1
3,600,735 A 8/1971 Jerabek (Continued)

FOREIGN PATENT DOCUMENTS

CN 101356384 A 1/2009
CN 100541930 C 9/2009

(Continued)

OTHER PUBLICATIONS

International Search Report and Written Opinion for International Application No. PCT/US2016/033091, dated Dec. 8, 2016, 17 pages.

*Primary Examiner* — Weilun Lo

(74) *Attorney, Agent, or Firm* — Fredrikson & Byron, P.A.

(57) ABSTRACT

A cleaning head assembly for a surface maintenance machine comprising a cleaning tool having a tool adapter, a driver adapted to provide a generally rotational motion to the cleaning tool to clean the floor surface, the driver being releasably connected to the tool adapter of the cleaning tool by a hub, and an aligning receptacle coupled to the tool adapter of the cleaning tool and positioned between the hub and the tool adapter, the aligning receptacle having an receptacle opening for receiving the hub, wherein the aligning receptacle is adapted to guide and matingly seat the hub into the receptacle opening and thereby engage the cleaning tool to the driver such that the cleaning tool and the driver are rotationally aligned and a rotational motion of the driver is transferred to the cleaning tool by the hub.

14 Claims, 21 Drawing Sheets

Related U.S. Application Data

(60) Provisional application No. 62/165,675, filed on May 22, 2015.

(51) Int. Cl.
*A47L 11/283* (2006.01)
*E01H 1/05* (2006.01)

(52) U.S. Cl.
CPC ..... *A47L 11/4055* (2013.01); *A47L 11/4069* (2013.01); *E01H 1/053* (2013.01)

(58) Field of Classification Search
USPC ..... 15/49.1
See application file for complete search history.

(56) References Cited

U.S. PATENT DOCUMENTS

| | | | | |
|---|---|---|---|---|
| 4,866,804 | A * | 9/1989 | Masbruch | A47L 11/164 15/49.1 |
| 5,347,673 | A | 9/1994 | Nickels, Jr. | |
| 5,421,053 | A | 6/1995 | Chodak | |
| 5,645,365 | A | 7/1997 | Malish et al. | |
| 5,806,132 | A | 9/1998 | Kelley | |
| 6,519,808 | B2 | 2/2003 | Legatt et al. | |
| 8,584,294 | B2 | 11/2013 | Loring | |
| 8,978,190 | B2 | 3/2015 | Leifheit et al. | |
| 9,474,426 | B2 | 10/2016 | Kamada | |
| 10,251,524 | B2 * | 4/2019 | Baker | A47L 11/4069 |
| 2003/0126729 | A1 | 7/2003 | Pierce | |
| 2008/0216259 | A1 | 9/2008 | Walz et al. | |
| 2011/0030163 | A1 | 2/2011 | Tucker et al. | |
| 2012/0118319 | A1 | 5/2012 | Stuchlik et al. | |
| 2012/0124760 | A1 | 5/2012 | Wahl et al. | |
| 2013/0005224 | A1 | 1/2013 | Leifheit et al. | |
| 2014/0007368 | A1 | 1/2014 | Larson | |
| 2014/0237743 | A1 | 8/2014 | Baker et al. | |
| 2015/0313435 | A1 * | 11/2015 | Citsay | A47L 11/4083 134/6 |

FOREIGN PATENT DOCUMENTS

| | | | |
|---|---|---|---|
| CN | 103423293 | A | 12/2013 |
| CN | 104549617 | A | 4/2015 |
| EP | 2248455 | B1 | 5/2012 |
| WO | 2008079944 | A2 | 7/2008 |

* cited by examiner

SURFACE MAINTENANCE MACHINE WITH A QUICK ALIGNMENT MECHANISM FOR A CLEANING TOOL

RELATED APPLICATIONS

This application is a continuation application of U.S. patent application Ser. No. 15/158,111 filed on May 18, 2016, which claims priority to U.S. Provisional Application No. 62/165,675 filed on May 22, 2015. The entire contents of each application is hereby incorporated by reference in their entirety.

FIELD

This disclosure generally relates to surface maintenance machines. More particularly the present disclosure relates to a cleaning head assembly for use with such machines, the cleaning head assembly having a quick alignment mechanism for a cleaning tool.

BACKGROUND

Surface maintenance machines include vehicles and devices that can be self-powered, towed, or pushed, and/or manually powered. Surface maintenance machines commonly include a cleaning head having one or more cleaning tools operated by one or more motors. Each cleaning tool is configured to perform a desired treating operation on the floor surface. For example, in cases where the surface maintenance machine is a floor scrubbing machine, the cleaning head includes one or more brushes that scrub the floor. Likewise, in cases where the surface maintenance machine is a floor sweeping machine, the cleaning head includes one or more brushes (e.g., a rotary broom) that contact the floor and throw loose debris into a hopper and one or more side brushes disposed laterally on the machine that move debris to the middle for the other brush to move debris into the hopper. The cleaning head is typically located on an underside of such surface maintenance machines.

A typical cleaning head generally includes a hub and driver that provides power to the cleaning tool (e.g., brush or pad). The hub attaches the cleaning tool to the driver. In order to attach a cleaning tool (e.g., a scrubbing brush, a sweeping brush, pad drivers for scrubbing, polishing, stripping and burnishing concrete and other hard surfaces comprising mastic, resin, and the like) to the hub, an operator typically manually positions the cleaning tool so that the axis of the hub and the axis of the cleaning tool are coaxial. The operator then uses their hands to rotate the cleaning tool until the cleaning tool aligns with the hub. The operator then forces the cleaning tool onto the hub and locks it in place via a locking mechanism (e.g., a spring-loaded clip). This can be a labor-intensive task for the operator. Further, because of poor visibility, poor reach and poor ergonomics under the surface maintenance machine, the operator may not successfully align the cleaning tool to the hub. Moreover, in some cases, the spring-loaded clip may have a spring force such that the operator applies a large force to overcome the spring force, thereby making the aligning and locking difficult.

SUMMARY OF THE INVENTION

Certain embodiments of the present disclosure provide a cleaning tool assembly for a surface maintenance machine comprising a cleaning tool releasably loaded to or unloaded from the surface maintenance machine, with a tool adapter for engaging with the surface maintenance machine. A driver having a rotating hub provides a generally rotational motion to the cleaning tool to clean the floor surface. The tool adapter can be releasably connectable to the hub and has a tool adapter interface of complementary shape to the hub such that the hub and tool adapter have one or more predetermined relative rotational orientations in which the hub and the tool adapter are engageable to interlock the rotation of the hub with the tool adapter. An aligning receptacle coupled to the tool adapter has a receptacle opening for receiving the hub. The aligning receptacle is positioned between the hub and the tool adapter when the hub and the tool adapter are moved toward each other generally along a rotational axis of the hub, to change the relative rotational orientation of the hub and the tool adapter into one of the one or more predetermine relative rotational orientations when the hub and the tool adapter are moved toward each other generally along the rotational axis of the hub to interlock the rotation of the hub with the tool adapter.

Certain embodiments of the present disclosure provide a cleaning tool assembly for a surface maintenance machine wherein a portion of the aligning receptacle has a chamfered surface directed in a generally downwardly direction and oriented in a generally radially inwardly direction toward a receptacle axis. The aligning receptacle is adapted to guide and seat the hub into the receptacle opening and thereby engage the cleaning tool to the driver such that the receptacle axis is coaxial with the rotational axis of the hub.

Certain embodiments of the present disclosure provide a spring-loaded clip disposed adjacent to surface of the tool adapter interface. The spring-loaded clip has a pre-loaded position and a locked position, the pre-loaded position suitable for installing the cleaning tool to the hub, and the locked position suitable for retaining the cleaning tool to the hub. The spring-loaded clip is spring-biased to move in a direction from the pre-loaded position to the locked position and is configured for securing the hub in the tool adapter interface in the locked position. The spring-loaded clip can be temporarily positionable into the pre-loaded position prior to securing the hub in the tool adapter. The engagement of the hub and the cleaning tool may cause the spring-loaded clip to move from the pre-loaded position to the locked position.

BRIEF DESCRIPTION OF DRAWINGS

The following drawings are illustrative of particular embodiments of the present disclosure. The drawings are not necessarily to scale (unless so stated) and are intended for use in conjunction with the explanations in the following detailed description. Embodiments of the present disclosure will hereinafter be described in conjunction with the appended drawings, wherein like numerals denote like elements.

DETAILED DESCRIPTION

The following detailed description is exemplary in nature and is not intended to limit the scope, applicability, or configuration of the present disclosure in any way. Rather, the following description provides some practical illustrations for implementing exemplary embodiments of the present disclosure. Examples of constructions, materials, dimensions, and manufacturing processes are provided for selected elements, and all other elements employ that which is known to those of ordinary skill in the field of the present disclosure. Those skilled in the art will recognize that many of the noted examples have a variety of suitable alternatives.

Figure 1:
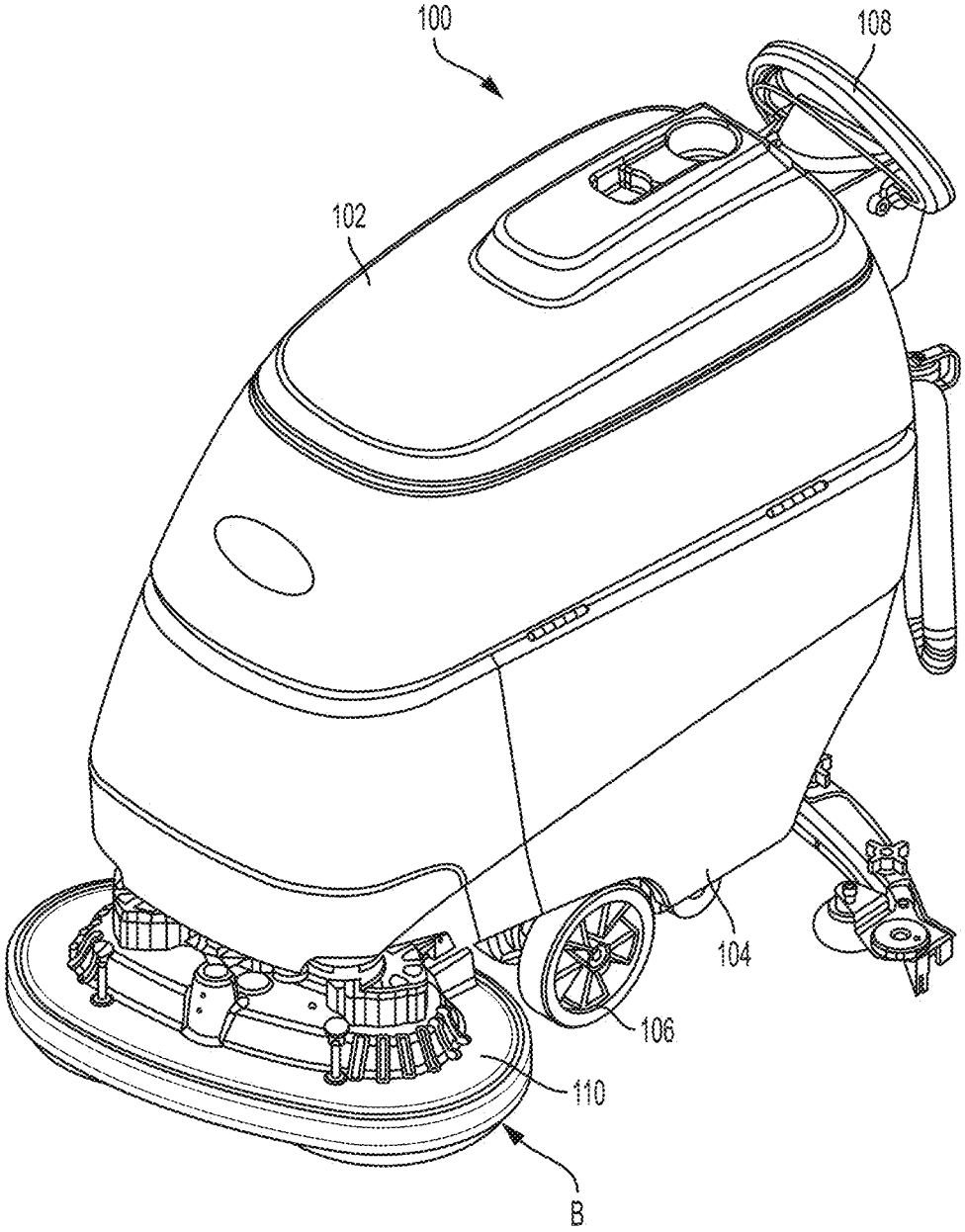
FIG. 1 is a perspective view of a surface maintenance machine according to an embodiment.
Figure 2:
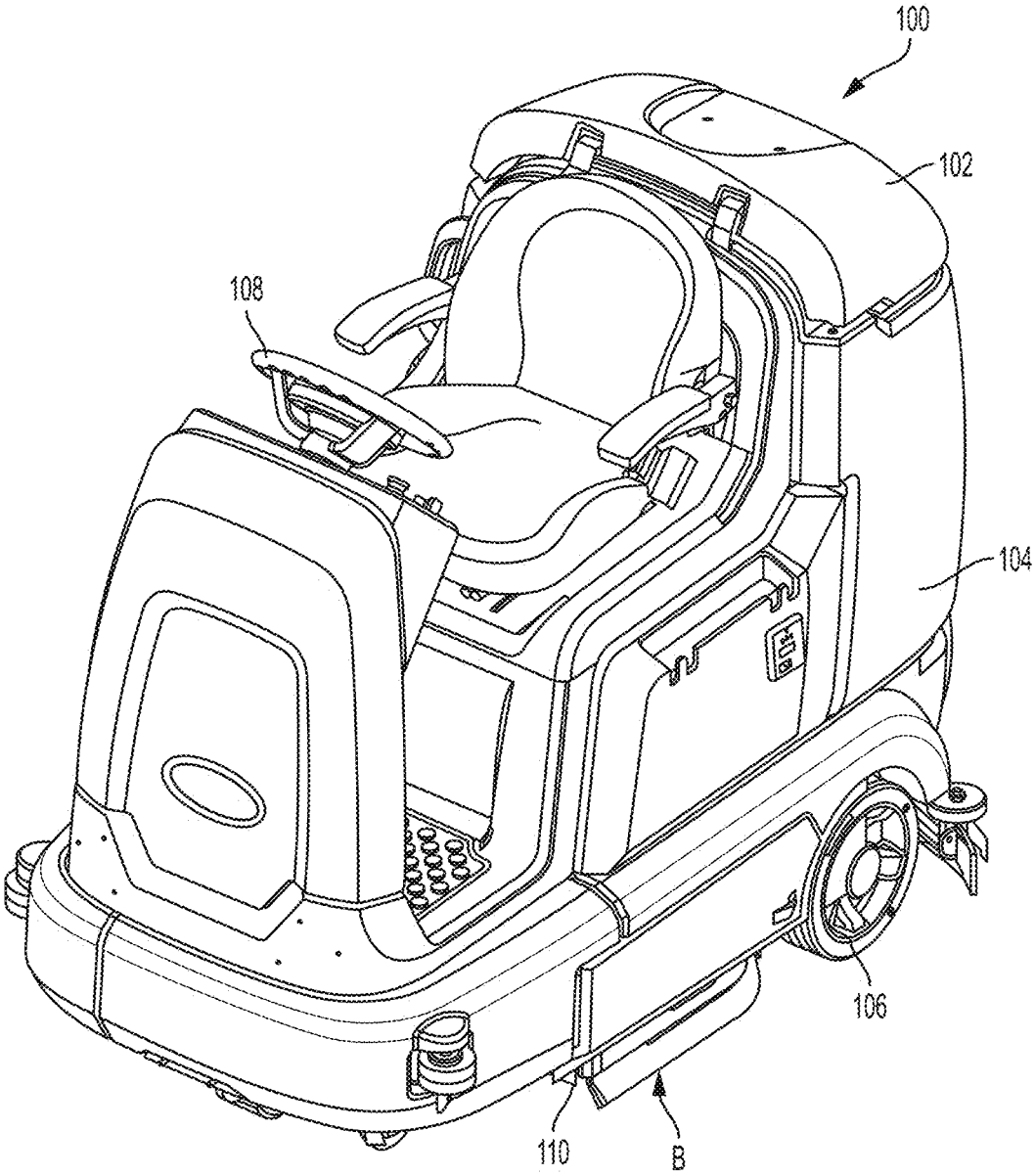
FIG. 2 is a perspective view of a surface maintenance machine according to another embodiment.

FIGS. 1 and 2 are perspective views of exemplary surface maintenance machines 100. In the illustrated embodiment shown in FIG. 1, the surface maintenance machine 100 is a walk-behind machine used to treat hard floor surfaces. In the illustrated embodiment shown in FIG. 2, the surface maintenance machine 100 is a ride-on machine. In other embodiments, the surface maintenance machine 100 can be a towed-behind machine, such as the surface maintenance machine 100 described in U.S. Pat. No. 8,584,294 assigned to Tennant Company of Minneapolis, Minn., the disclosure of each of which is hereby incorporated by reference in its entirety. The surface maintenance machine 100 can perform maintenance tasks such as sweeping, scrubbing, polishing (burnishing) a surface. The surface can be a floor surface, pavement, road surface and the like.

Embodiments of the surface maintenance machine 100 include components that are supported on a mobile body 102. As best seen in FIGS. 1 and 2, the mobile body 102 comprises a frame 104 supported on wheels 106 for travel over a surface, on which a surface maintenance operation is to be performed. The mobile body 102 may include operator controls (not shown) and a steering control such as a steering wheel 108. The surface maintenance machine 100 can be powered by an on-board power source such as one or more batteries or an internal combustion engine (not shown). The power source can be proximate the front of the surface maintenance machine 100, or it may instead be located elsewhere, such as within the interior of the surface maintenance machine 100, supported within the frame 104, and/or proximate the rear of the surface maintenance machine 100. Alternatively, the surface maintenance machine 100 can be powered by an external electrical source (e.g., a power generator) via an electrical outlet. The interior of the surface maintenance machine 100 can include electrical connections (not shown) for transmission and control of various components.

In some embodiments, the interior of the surface maintenance machine 100 can include a vacuum system for removal of debris from the surface. In some embodiments, the interior can include a fluid source tank (not shown) and a fluid recovery tank (not shown). The fluid source tank can include a fluid source such as a cleaner or sanitizing fluid that can be applied to the floor surface during treating operations. The fluid recovery tank holds recovered fluid source that has been applied to the floor surface and soiled. The interior of the surface maintenance machine 100 can include passageways (not shown) for passage of debris and dirty water.

Figure 3:
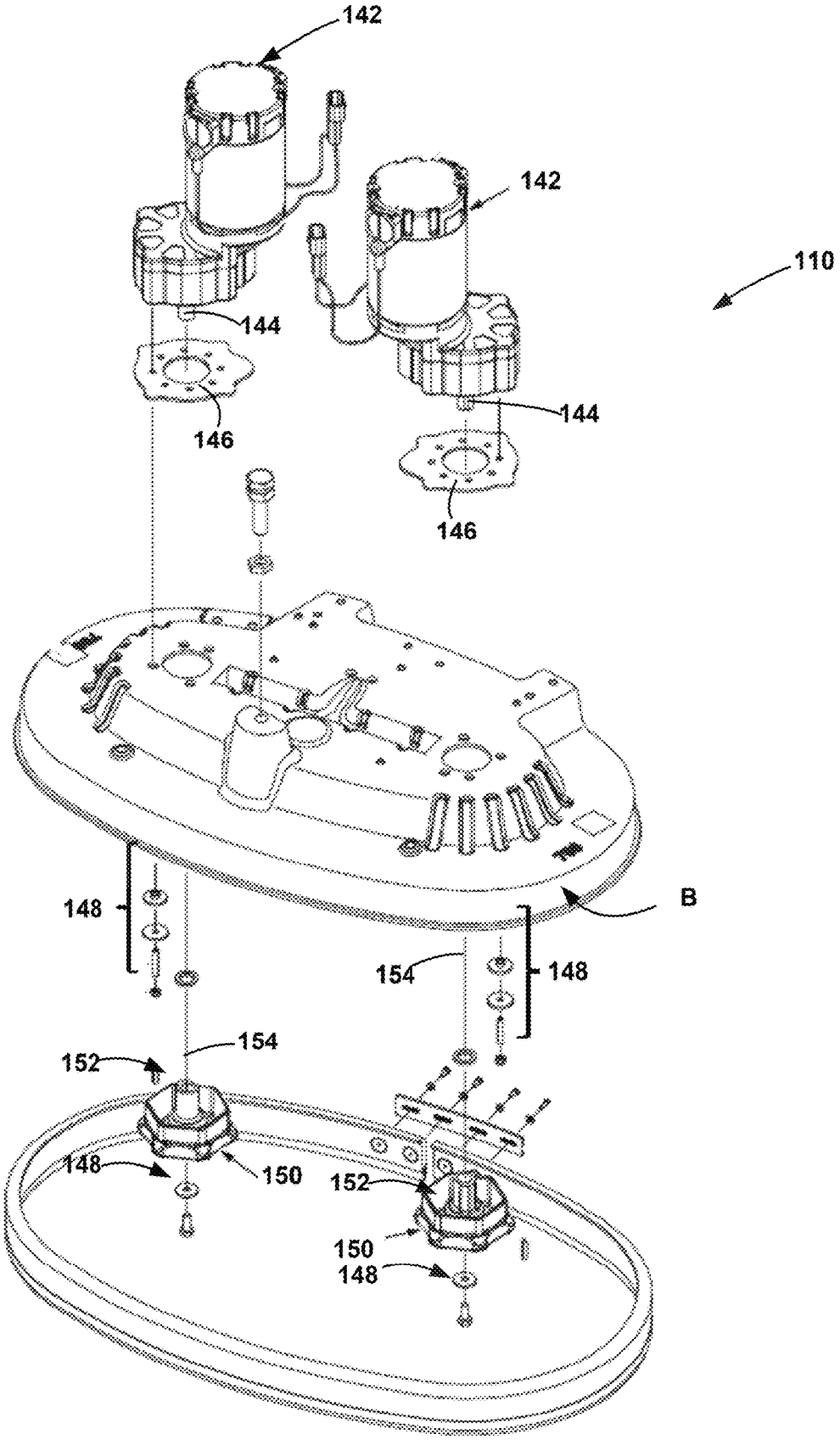
FIG. 3 is an exploded perspective view of a portion of a cleaning head assembly according to an embodiment.
Figure 4:
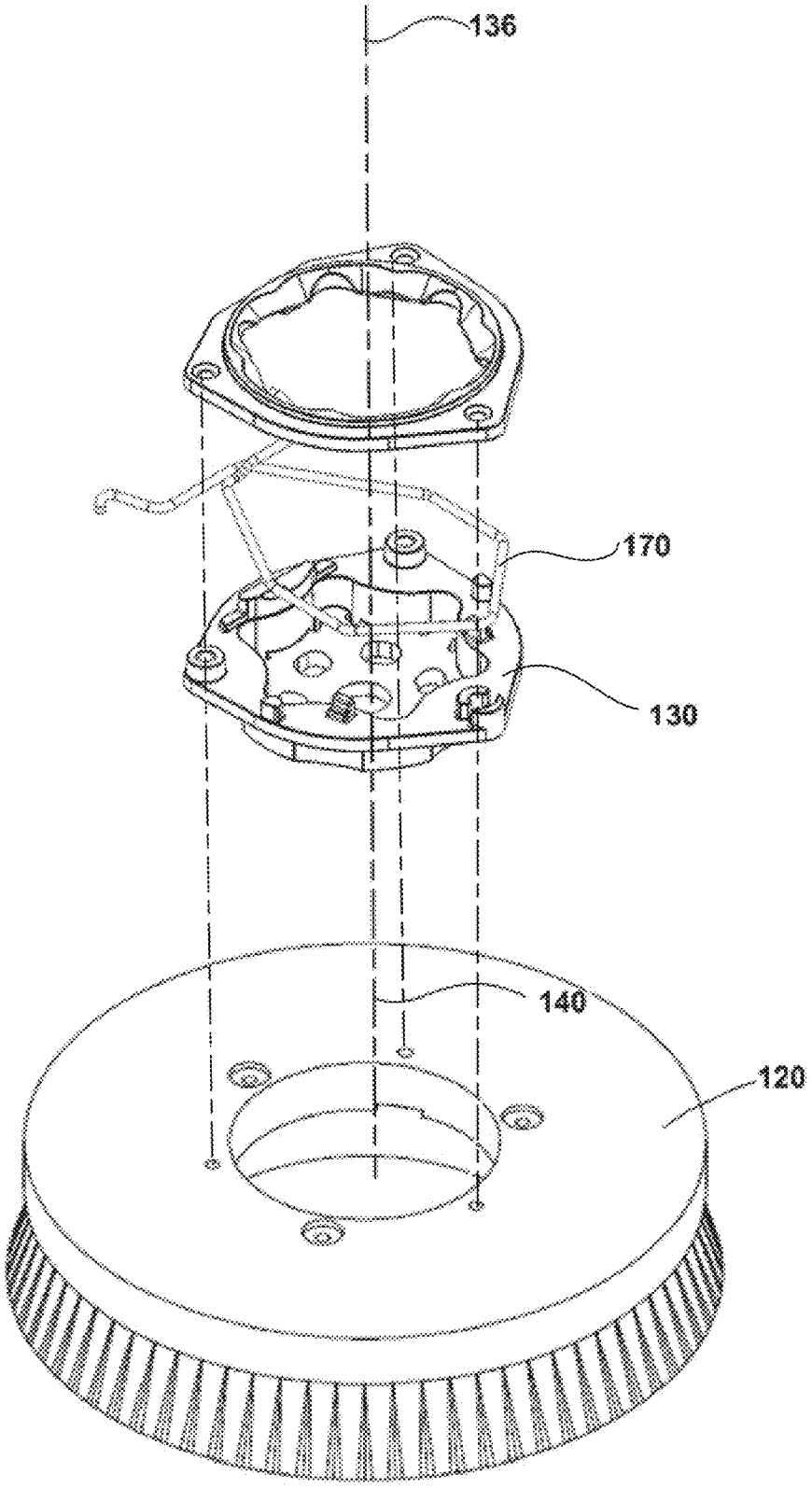
FIG. 4 is an exploded perspective view of a cleaning tool according to an embodiment.
Figure 5:
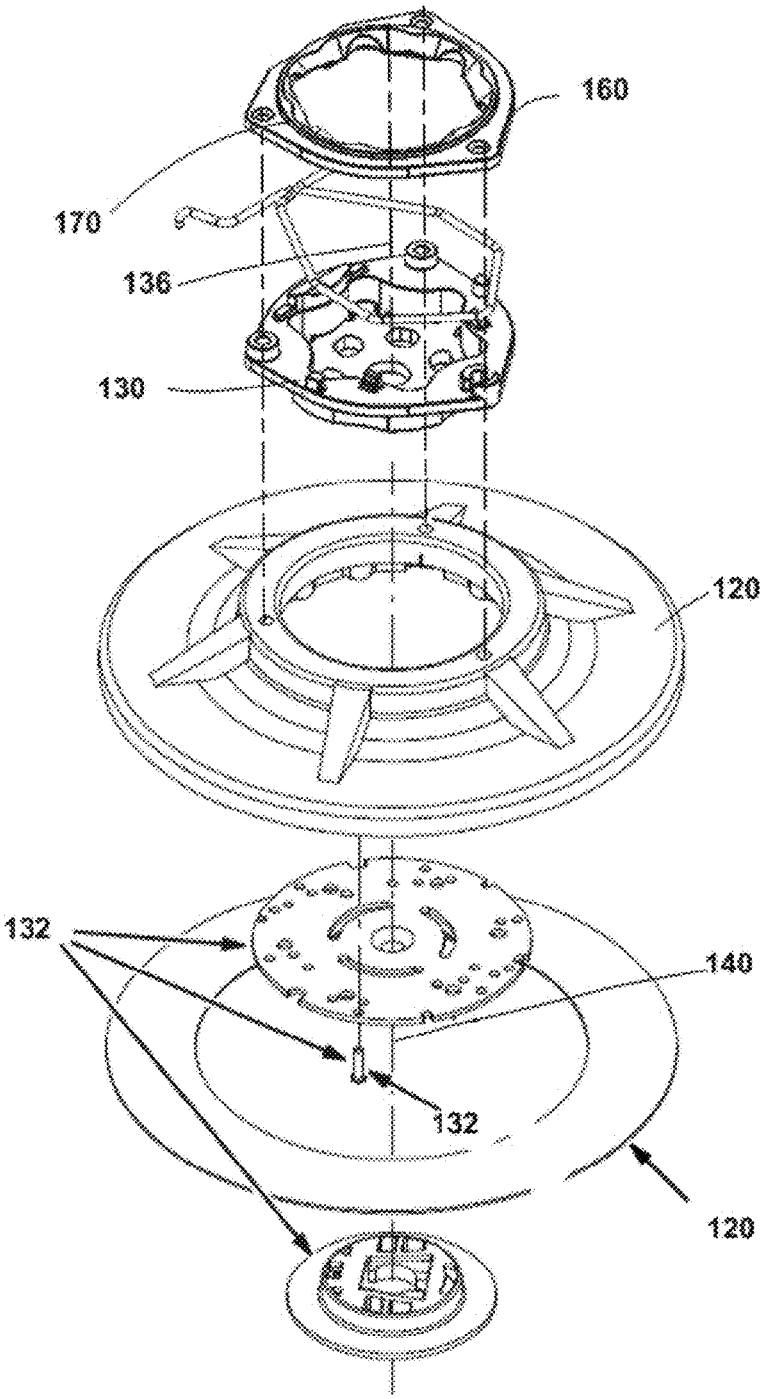
FIG. 5 is an exploded perspective view of a cleaning tool according to another embodiment.

Referring now to FIG. 3, the surface maintenance machine 100 includes a cleaning head assembly 110. In the embodiment illustrated in FIG. 3, the cleaning head assembly 110 houses two cleaning tools. Alternatively, the cleaning head assembly 110 can house any number of cleaning tools. The cleaning tools can be a brush as shown in FIG. 4 or a pad as shown in FIG. 5 that can be releasably loaded to or unloaded from the surface maintenance machine 100. The cleaning tools can be one or more rotatable cleaning tools, such as scrub brushes, sweeping brushes, and polishing, stripping or burnishing pads. Many different types of cleaning tools are used to perform one or more cleaning operations on the floor surface. These include sweeping, scrubbing brushes, polishing/burnishing and/or buffing pads. Additionally, one or more side brushes for performing sweeping, scrubbing or other operations can be provided. The cleaning head assembly 110 can be attached to the base of the surface maintenance machine 100 such that the cleaning head can be lowered to a cleaning position and raised to a traveling position. The cleaning head assembly 110 is connected to the surface maintenance machine 100 using any known mechanism, such as a suspension and lift mechanism such as those illustrated in U.S. Pat. No. 8,584, 294 assigned to Tennant Company of Minneapolis, Minn., the disclosure of each of which is hereby incorporated by reference in its entirety.

During a floor surface maintenance operation, an operator may be required to change one or more cleaning tools to perform one or more of floor surface maintenance operations. Additionally, the operator may want to inspect the cleaning tool and/or replace the cleaning tool when it has reached the end of its usable life. In such cases, the operator may desire quickly removing and/or replacing cleaning tools.

Referring now to FIGS. 4 and 5, the cleaning tool 120 has a tool adapter 130 for interchangeably connecting a cleaning tool 120 to the surface maintenance machine 100. The tool adapter 130 can mechanically engage with the cleaning tool 120 (e.g., with a plurality of fasteners 132) as illustrated in FIGS. 4 and 5. The tool adapter 130 facilitates connecting different types of cleaning tools to the floor surface cleaning machine. The shape and size of the tool adapter 130 and the connection between the tool adapter 130 and the cleaning tool 120 can be standardized to facilitate engaging various commercially available cleaning tools with the surface maintenance machine 100.

With continued reference to FIGS. 4 and 5, the tool adapter 130 is rigidly connected to the cleaning tool 120. The connection between the tool adapter 130 and the cleaning tool 120 can be removable (e.g., fasteners) so as to facilitate replacement of the cleaning tool 120. For instance, the tool adapter 130 can be connected to the cleaning tool 120 by a plurality of fasteners, a bracket and the like (not shown). In some cases, the tool adapter 130 comprises a tool adapter axis 136 and a tool adapter interface 138. The cleaning tool 120 can be connected to the tool adapter 130 such that an axis 140 of the cleaning tool 120 is concentric with the tool adapter axis 136. When mounted in this manner, the tool adapter 130 is coaxial with the cleaning tool 120.

Referring back to FIG. 3, the cleaning tool 120 can be powered by a driver 142 that provides a generally rotational motion to the cleaning tool 120 to clean the floor surface. In the embodiments illustrated in FIG. 3, the cleaning head assembly 110 houses two cleaning tools (such as two brushes, two pads, a brush and a pad or other cleaning tools) in the cleaning head assembly 110. In this case, the cleaning head assembly 110 includes a pair of drivers, each driver 142 powering a cleaning tool 120. In some cases such as those shown in FIG. 3, the driver 142 is a motor having a driver shaft 144 coupled (e.g., mechanically or magnetically) to the cleaning tool 120 via the tool adapter 130. For instance, as shown in FIG. 3, the motor shaft may be connected mechanically via flanges 146 and a bolted connection 148 to the cleaning tool 120 as will be described below. Alternatively, the driver 142 and the cleaning tool 120 can be magnetically coupled. For instance a plurality of magnets or magnetic materials may be used in fabricating portions of the driver shaft 144 and the cleaning tool 120 so that the driver 142 is magnetically coupled to the cleaning tool 120. Such mechanical or magnetic coupling facilitates transmission of the rotational motion of the driver 142 to the cleaning tool 120.

In some cases best illustrated in FIGS. 3-5, the cleaning head assembly 110 can include a hub 150 connected to the driver 142 and the cleaning tool 120. The hub 150 can transmit the rotational motion of the driver 142 to the cleaning tool 120. Referring back to FIG. 3, the driver shaft 144 which is received by an opening 152 in the hub 150. The driver 142 and the hub 150 are therefore rotationally coupled, such that any rotational motion of the driver 142 rotates the hub 150 at about the same rotational speed and substantially same rotational direction as the rotating portions of the driver 142 (e.g., driver shaft 144). As illustrated, the driver shaft 144 is coaxial with the opening 152 in the hub 150. Referring now to FIGS. 4 and 5, the tool adapter 130 is rigidly coupled to the cleaning tool 120 by a bracket and a plurality of fasteners that hold the tool adapter 130 securely in place on the cleaning tool 120. When the hub 150 is received by the tool adapter interface 138, the rotational motion of the driver 142 is transmitted to the tool adapter 130 because of the mechanical coupling (e.g., frictional fit) between the hub 150 and the tool adapter 130. In the illustrated embodiments, for instance, the driver 142, the hub 150 and the tool adapter 130 are coaxially coupled (e.g., rotational axis 154 of the hub 150 being coaxial with the tool adapter axis 136). In turn, the tool adapter 130 is rigidly coupled (e.g., releasably via brackets and fasteners) coaxially to the cleaning tool 120, and the rotational motion of the hub 150 is further transmitted to the cleaning tool 120 because of the mechanical coupling between the tool adapter 130 and the cleaning tool 120. As a result, the cleaning tool 120 rotates in substantially the same direction as the driver 142 with the axis of rotation being the axis of the driver 142 because of coaxial positioning of the driver 142, hub 150, tool adapter 130 and the cleaning tool 120.

Figure 16B:
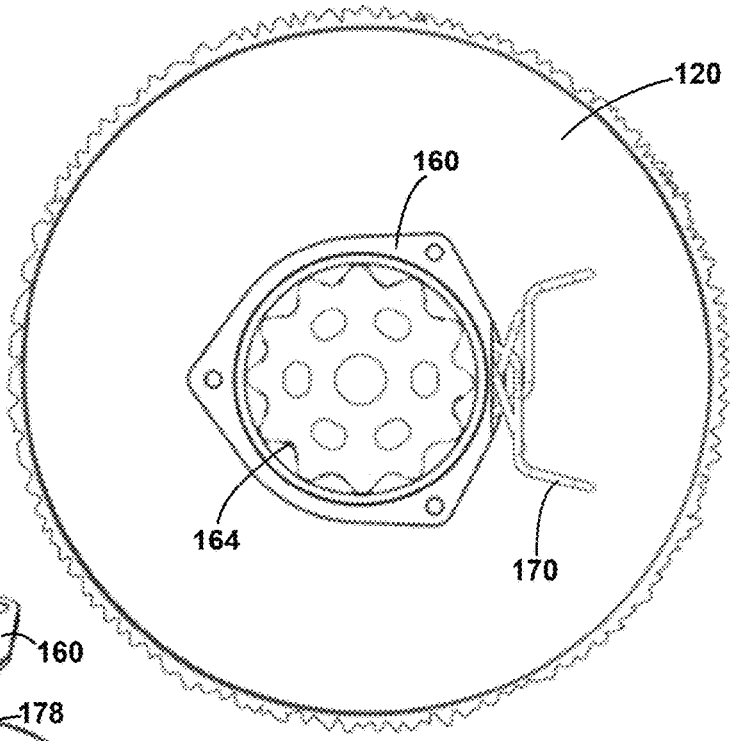
FIGS. 16A-C illustrate a front perspective and a top plan view of a cleaning tool with an aligning receptacle according to another embodiment.
Figure 16A:
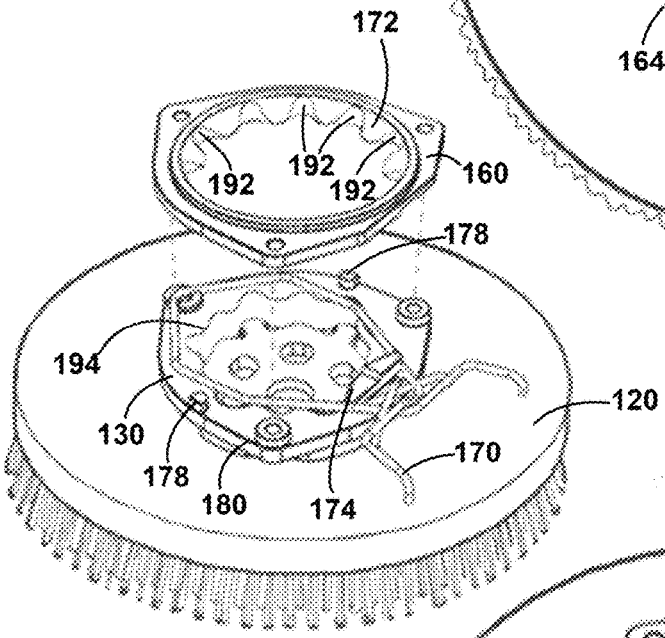
Figure 16C:
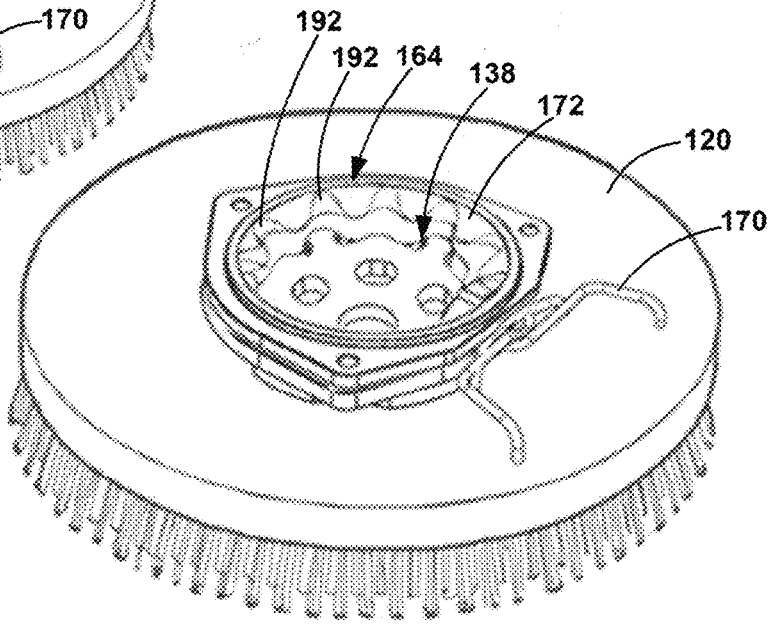

In some cases, the tool adapter interface 138 has a shape which is complementary to the shape of the hub 150. In the illustrated embodiments, the hub 150 is star shaped. The hub 150 can have one or more lugs 150A, 150B. Accordingly, the tool adapter interface 138 is star shaped. The tool adapter 130 and the hub 150 are shaped and oriented such that the hub 150 transmits a rotational motion of the driver 142 to the cleaning tool 120 without slippage occurring between the hub 150 and the tool adapter 130. While a six-pointed star shaped hub 150 and a complementary tool adapter interface 138 are illustrated in FIGS. 4 and 5, the hub 150 can be of other shapes (e.g., as illustrated in FIG. 16A-C), such as star shaped with any number of points of the star (e.g., eight, ten or twelve-pointed star with eight, ten or twelve lugs respectively). Alternatively, the hub 150 can be hexagonal, octagonal or other polygonal shapes. The shape of the hub 150 can be rotationally symmetric about the rotational axis 154 of the hub 150. Likewise, the shape of the tool adapter interface 138 can be rotationally symmetric about the tool adapter axis 136. The hub 150 and the tool adapter interface 138 can be of a complementary shape that such that the hub 150 and tool adapter 130 have one or more predetermined relative rotational orientations in which the hub 150 and the tool adapter 130 are engageable to interlock the rotation of the hub 150 with the tool adapter 130. The shape of the hub 150 and the tool adapter interface 138 can be configured such that the tool adapter interface 138 provides at least limited gimbaling of the hub 150 in the tool adapter 130. For instance, when the surface maintenance machine 100 moves from a flat floor surface to a ramp, or a floor surface having undulations, the limited gimbaling between the hub 150 and the tool adapter 130 (and consequently the cleaning tool 120) may act in a manner similar to a knuckle joint, thereby ensuring that the cleaning tool 120 follows the undulations of the floor while still maintaining the rotational coupling between the hub 150 and the cleaning tool 120.

Figure 6:
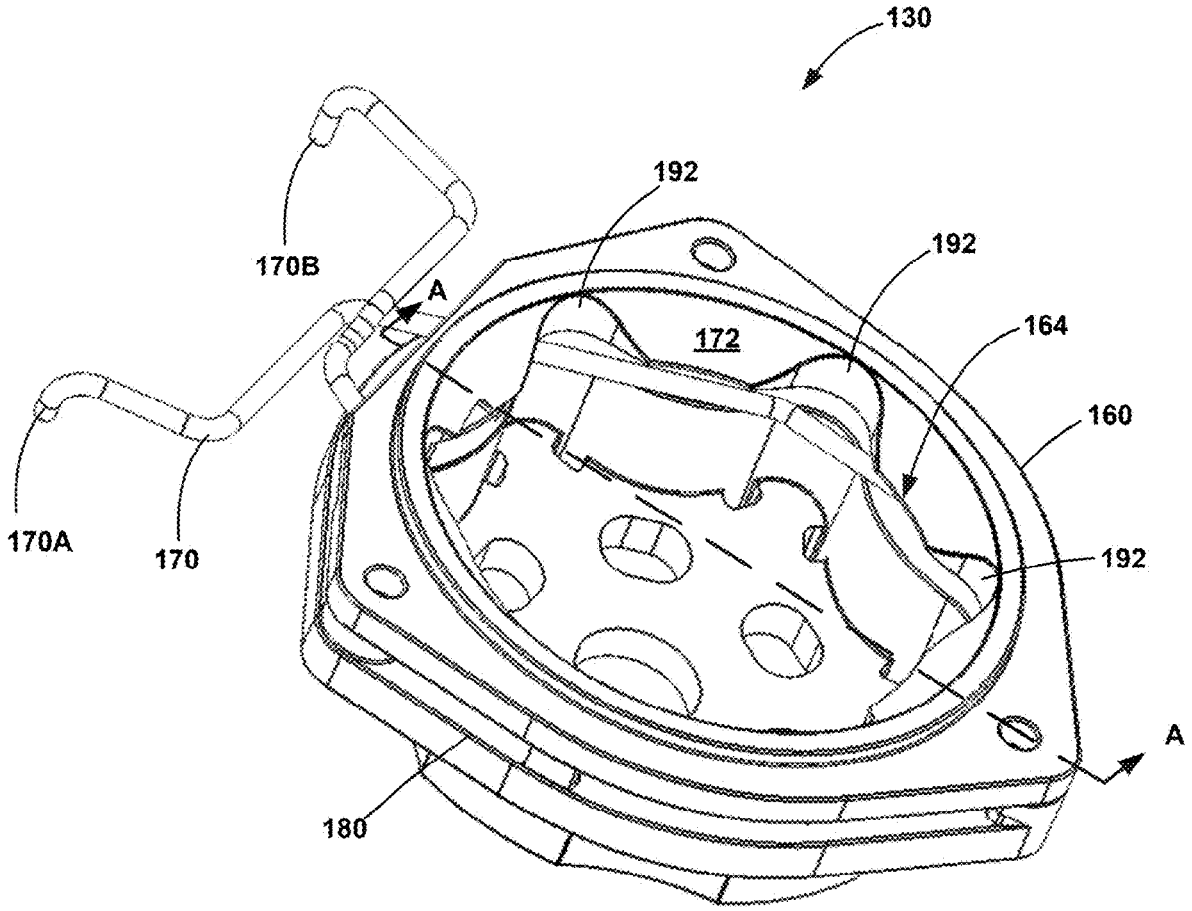
FIG. 6 is a perspective view of a tool adapter according to an embodiment.
Figure 7:
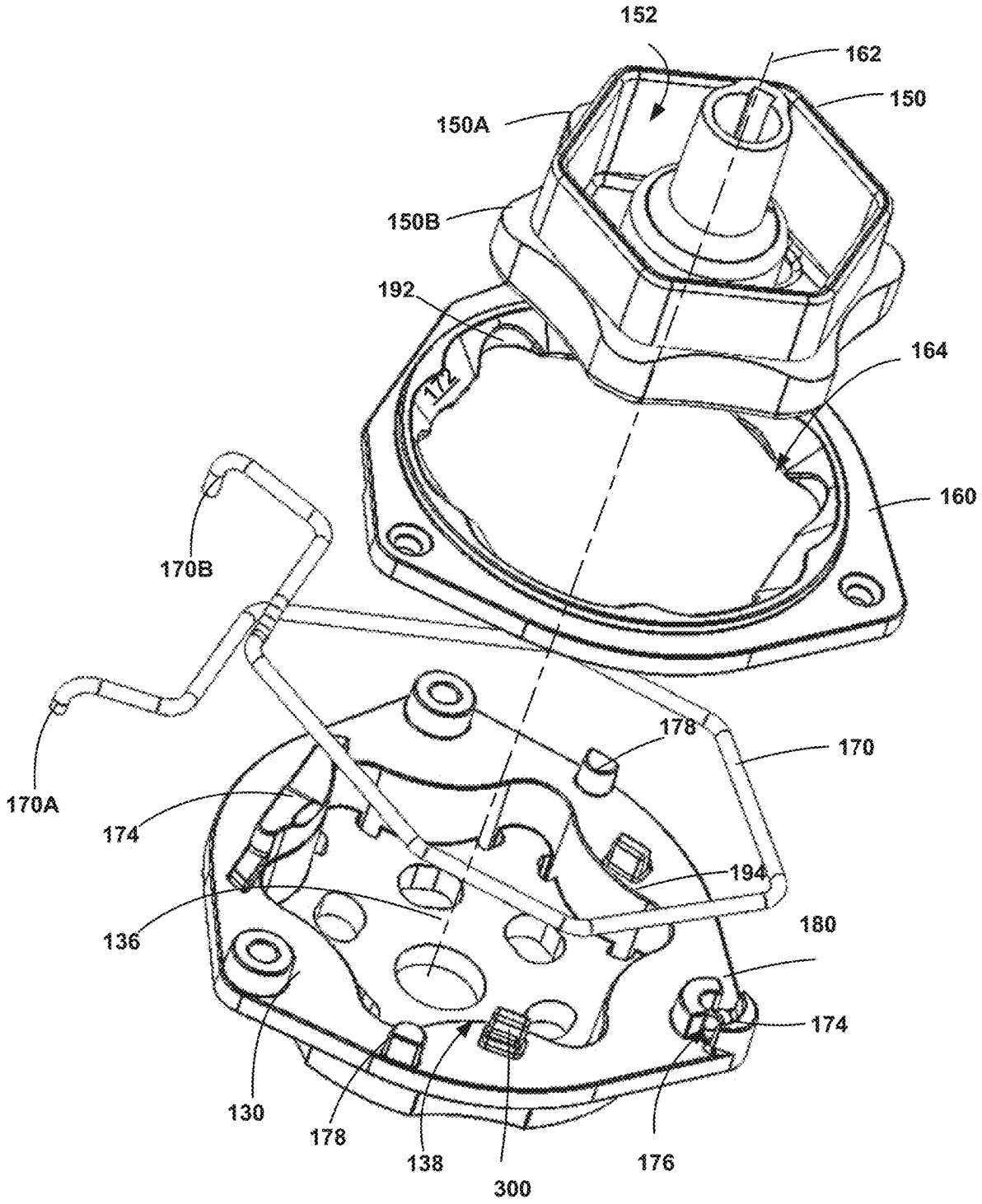
FIG. 7 is an exploded perspective view of the tool adapter of FIG. 5.
Figure 8:
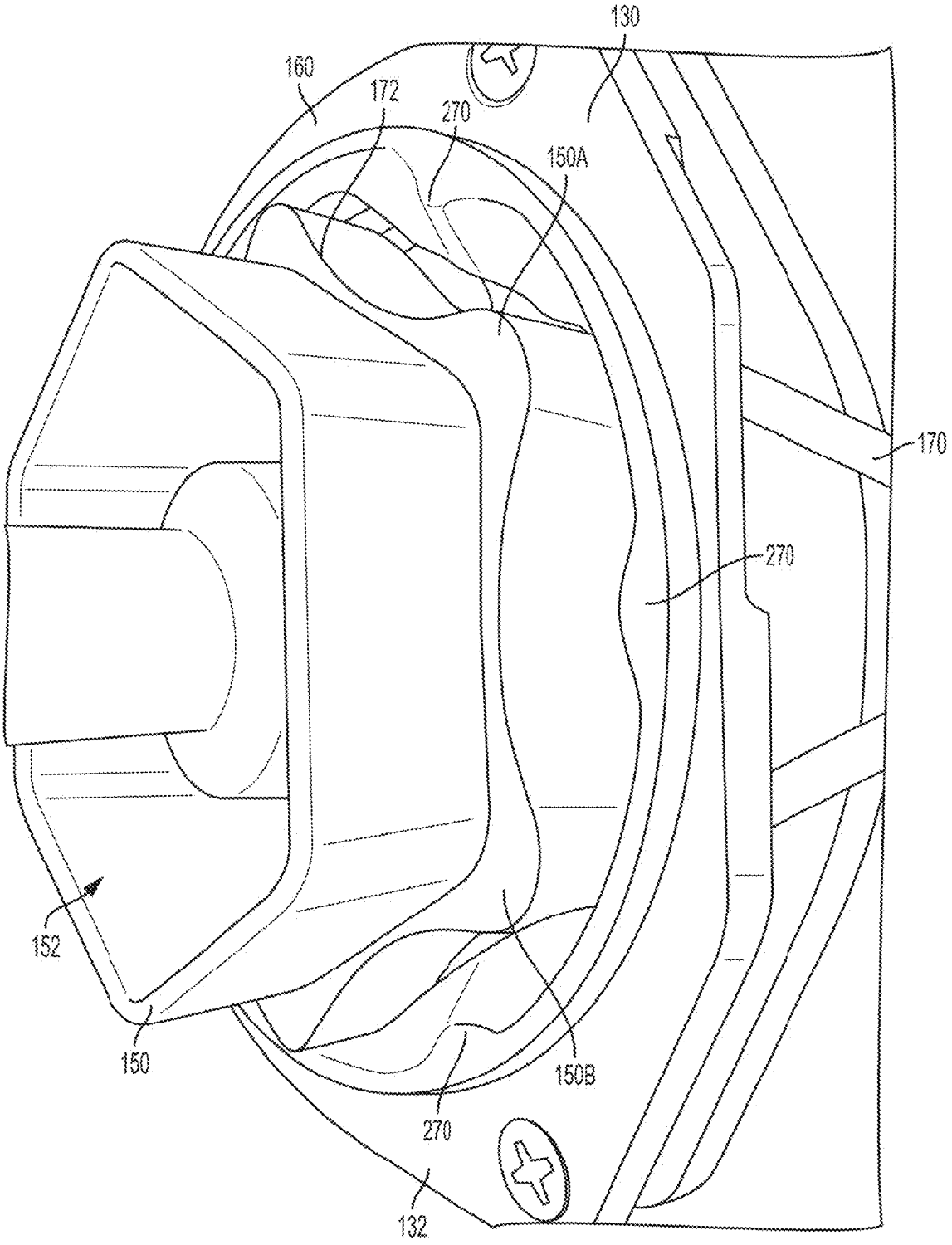
FIG. 8 is a perspective view of the tool adapter of FIG. 7 illustrated with an aligning receptacle.

Referring now to FIGS. 6-9, the cleaning head assembly 110 includes an aligning receptacle 160 coupled to the tool adapter 130 of the cleaning tool 120. As seen in FIGS. 6 and 7, the aligning receptacle 160 can be positioned between the hub 150 and the tool adapter 130 when the hub 150 and the tool adapter 130 are moved toward each other along a rotational axis 154. Referring back to FIG. 3, the hub 150 has a rotational axis 154 defined in a generally vertical direction (and/or transverse to the direction over which the machine 100 moves). As shown in FIG. 7, the aligning receptacle 160 has a receptacle axis 162 defined in a generally longitudinal direction. The aligning receptacle 160 can have a receptacle opening 164 for receiving the hub 150. As seen in FIG. 8, a shape of the receptacle opening 164 is complementary to a shape of the hub 150. As described previously, the hub 150 can have many different shapes (e.g., polygonal, star with any number of points, and the like). The receptacle opening 164 can be shaped to be polygonal, star with any number of points, and the like. The receptacle opening 164 may be rotationally symmetric about the receptacle axis 162. Alternatively, in other embodiments, the receptacle opening 164 may not have rotational symmetry about the receptacle axis 162. The aligning receptacle 160 can change the relative rotational orientation of the hub 150 and the tool adapter 130 into one of the one or more predetermine relative rotational orientations when the hub 150 and the tool adapter 130 are moved toward each other generally along the rotational axis 154 of the hub 150 to interlock the rotation of the hub 150 with the tool adapter 130. For instance, if the hub 150 is star shaped, the receptacle opening 164 is star shaped to receive the hub 150. This facilitates the aligning receptacle 160 in guiding and matingly seating the hub 150 into the receptacle opening 164. When seated, the engagement between the hub 150 and the receptacle engages the cleaning tool 120 to the driver 142 such that the cleaning tool 120 and the driver 142 are rotationally aligned (e.g., the rotational axis 154 and the receptacle axis 162 being coaxial), and a rotational motion of the driver 142 is transferred to the cleaning tool 120 by the hub 150. For instance, the driver 142 and the cleaning tool 120 can be rotationally aligned, such that if the driver 142 rotates at a given speed and in a given direction (e.g., clockwise), the cleaning tool 120 can substantially rotate in a clockwise direction at a substantially same speed as the driver 142.

Referring back to FIGS. 4 and 5, the tool adapter 130 has a spring-loaded clip 170 positioned thereon. While the spring-loaded clip 170 is illustrated as a single unitary component, the spring-loaded clip 170 can have any shape. Additionally, the spring-loaded clip 170 can have several structural elements (not illustrated) for grasping and clamping the hub 150 once it is seated in the tool adapter 130 of the cleaning tool 120. The spring-loaded clip 170 can lock the hub 150 in the tool adapter 130 after the cleaning tool 120 is loaded to the surface maintenance machine 100. In such cases, the spring-loaded clip 170 expands radially outwardly away from the tool adapter axis 136 when loading the cleaning tool 120 to the surface maintenance machine 100 and contracts radially inwardly toward the tool adapter axis 136 when the cleaning tool 120 is loaded. The radially-inwardly directed contraction of the spring-loaded clip 170 locks the hub 150 in the tool adapter 130. The radially-inwardly directed contraction of the spring-loaded clip 170 holds the cleaning tool 120 in place in the surface maintenance machine 100 and thereby secures the hub 150 on to the tool adapter 130. In use, an operator can slide a cleaning tool 120 such as a brush or a pad from underneath a bottom surface (e.g., surface "B" shown in FIGS. 1 and 2) and apply an applied force to push the cleaning tool 120 up against the hub 150 (or vice versa). The applied force is opposed by a spring force of the spring-loaded clip 170. The spring-loaded clip 170, positioned on the cleaning tool 120 extends radially outwardly due to the upwardly directed pushing force against the hub 150 provided by the operator. Once the operator stops pushing the cleaning tool 120 against the hub 150, the spring-loaded clip 170 retracts radially inwardly, and grasps the hub 150 and thereby holds the hub 150 onto the cleaning tool 120. In some cases, a user can also manually apply a force on the spring-loaded clip 170 (e.g., by pinching the ends 170A and 170B of the spring-loaded clip 170 shown in FIGS. 4 and 5) to extend it radially outwardly. At the same time, the operator can align the cleaning tool 120 so that the hub 150 is received in the tool adapter interface 138 and release the spring-loaded clip 170. Once released, the spring-loaded clip 170 can grasp the hub 150 and secure it to the cleaning tool 120. As will be explained herein with respect to FIGS. 18-23, the applied force to push the tool on to the hub can be reduced by a spring lockout feature.

Figure 10:
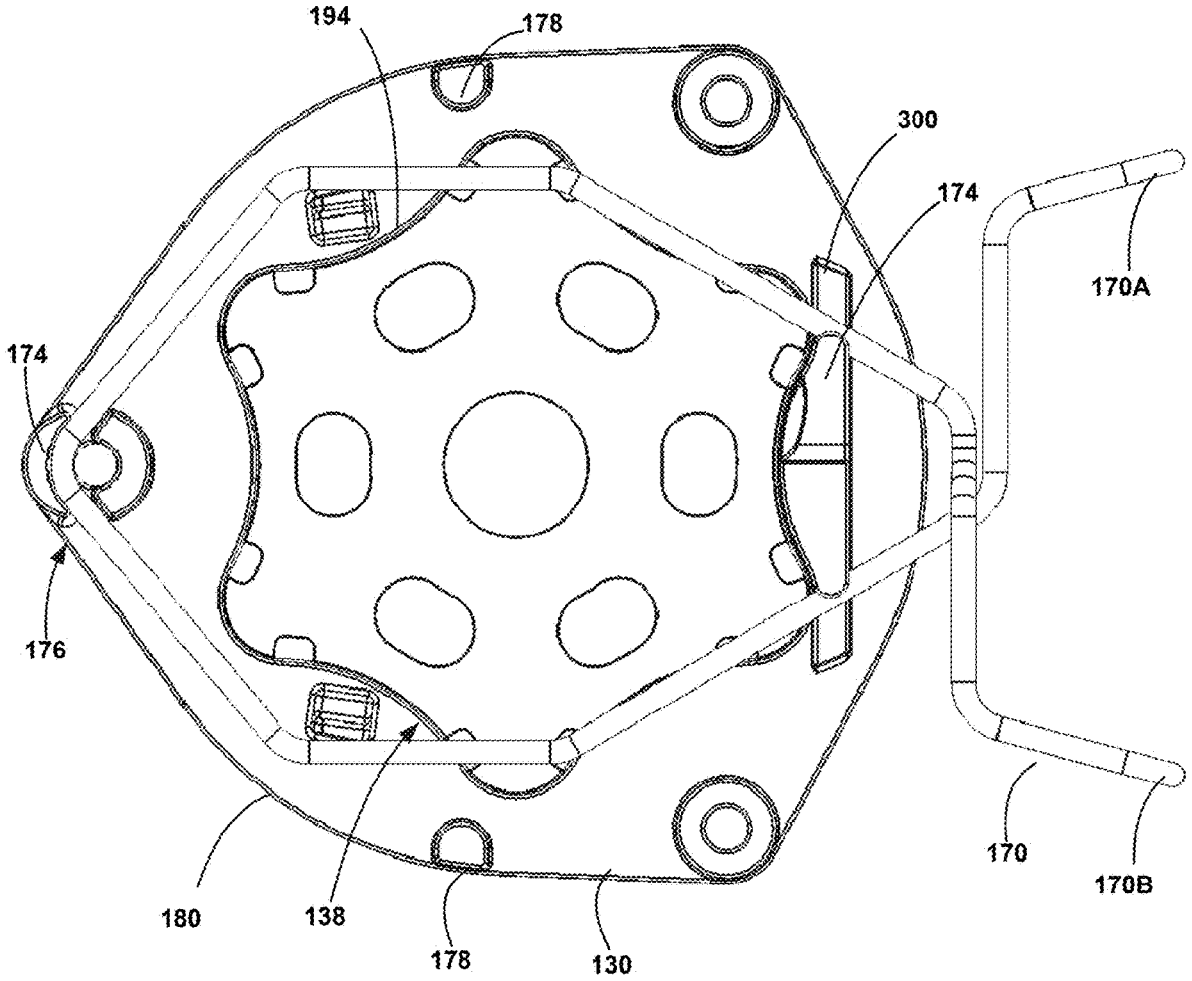
FIG. 10 is a top plan view of the tool adapter of FIG. 5 illustrated without the aligning receptacle and with a spring-loaded clip according to an embodiment.
Figure 11:
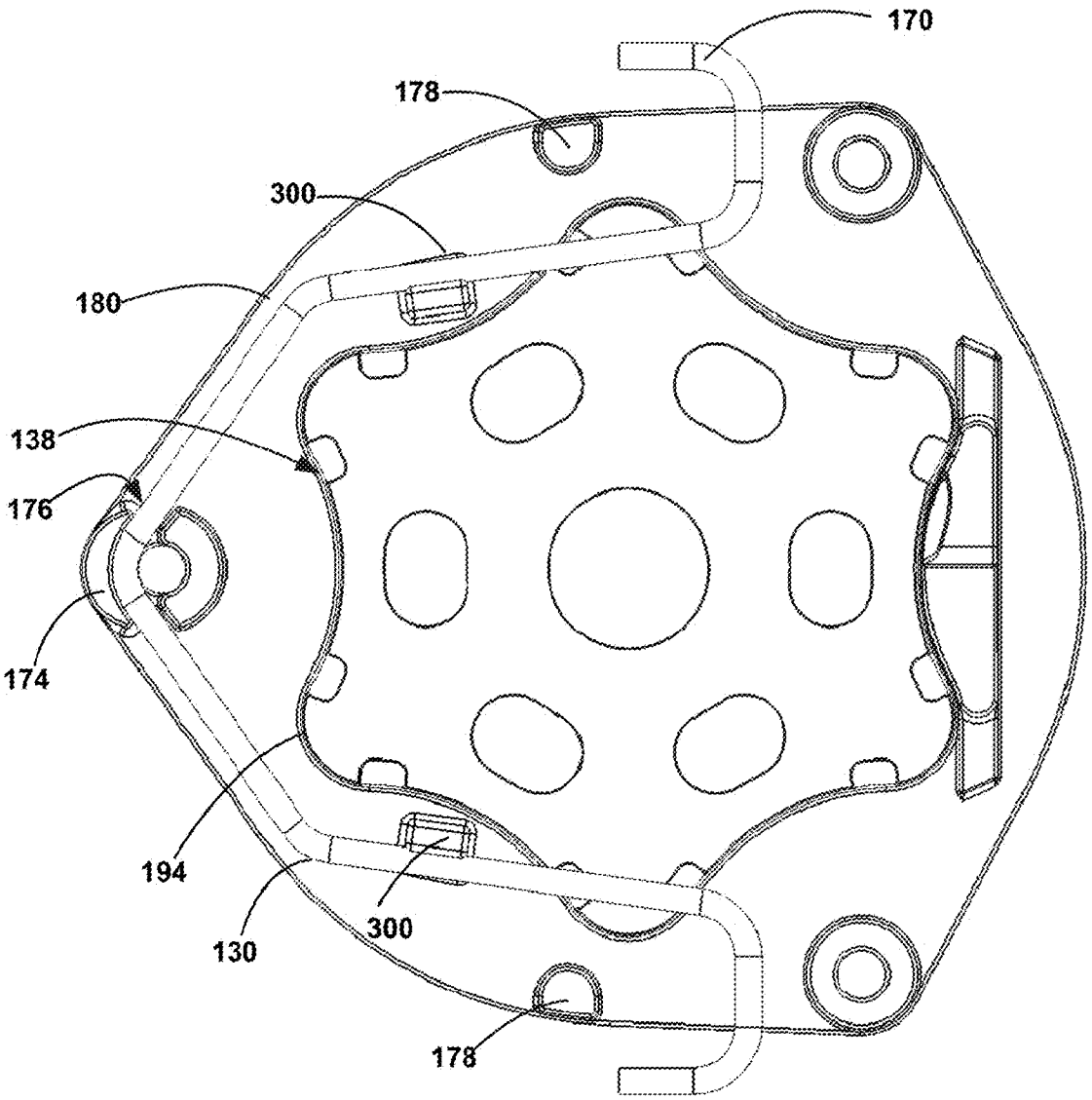
FIG. 11 is a top plan view the tool adapter of FIG. 5 illustrated without the aligning receptacle and with a spring-loaded clip according to another embodiment.

As mentioned above, in use, the operator slides the cleaning tool 120 underneath the surface maintenance machine 100, and pushes the tool against the hub 150 to seat the hub 150 in the tool adapter 130. As shown in FIGS. 10 and 11, the spring-loaded clip 170 partially extends into the tool adapter interface 138 in order to securely clamp the hub 150 in the tool adapter 130. This may make it challenging for an operator to axially and circumferentially align the tool adapter 130 and the hub 150 as the operator may not receive any tactile information (e.g., sliding, seating motion) because a perimeter edge of the hub 150 may not directly contact a perimeter edge of the tool adapter interface 138. Particularly, the operator may not be able to access various components of the cleaning head assembly 110 as they are positioned below the bottom surface "B" (shown in FIGS. 1 and 2) of the surface maintenance machine 100, and there may be limited clearance between the ground and the cleaning head assembly 110. Additionally, the surface maintenance machine's body 102 may have lateral surfaces that visually conceal the cleaning head assembly 110 (e.g., as shown in FIG. 2). In turn, the operator may be unable to receive visual or tactile information on the position and shape of the hub 150 when attempting to load the cleaning tool 120 to the surface maintenance machine 100. In such cases, and as shown in FIG. 8, the aligning receptacle 160 can be configured to facilitate aligning the cleaning tool 120 to the hub 150, so that the driver 142, hub 150 and cleaning tool 120 are coaxially positioned. Further, the aligning receptacle 160 can facilitate aligning the hub 150 and the cleaning tool 120 circumferentially (e.g., by complementary engagement between the hub 150 and the receptacle opening 164). As seen in FIG. 8, the aligning receptacle 160 is placed above the spring-loaded clip 170 to guide the operator in aligning the cleaning tool 120 with the hub 150.

Figure 9:
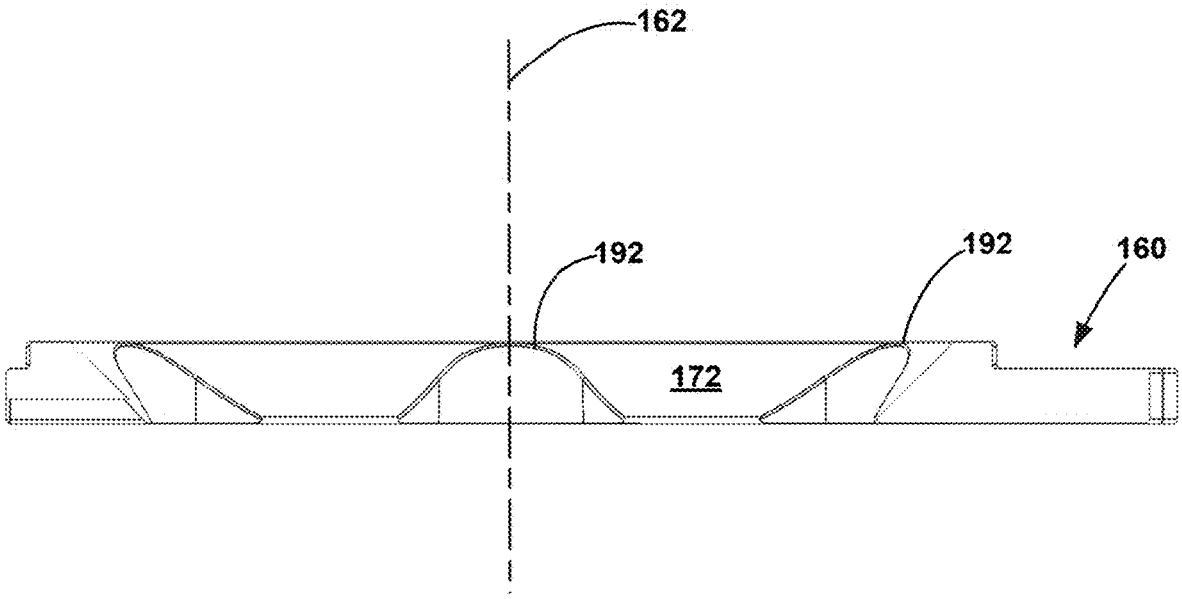
FIG. 9 is a cross-sectional front view of the aligning receptacle taken along the line A-A shown in FIG. 5.
Figure 15B:
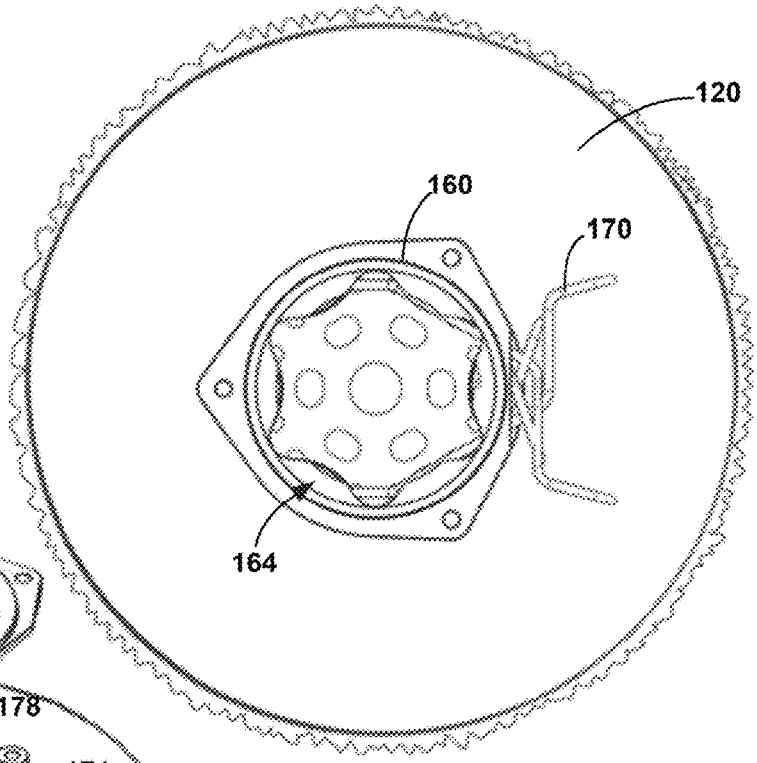
FIGS. 15A-C illustrate a front perspective and a top plan view of a cleaning tool with an aligning receptacle according to another embodiment.
Figure 15A:
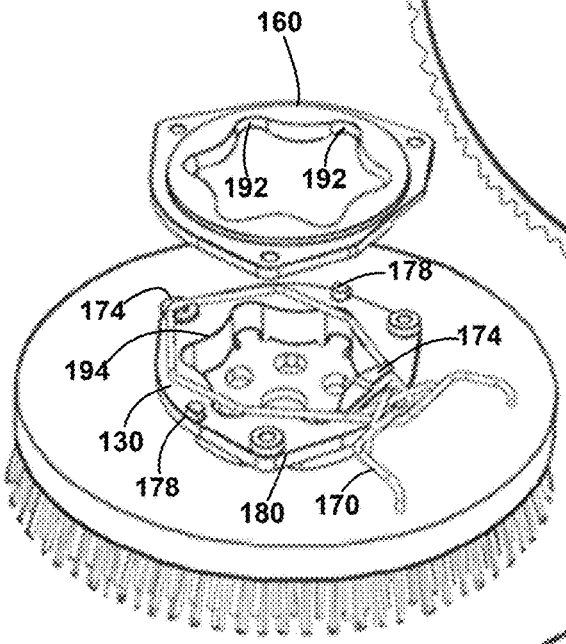
Figure 15C:
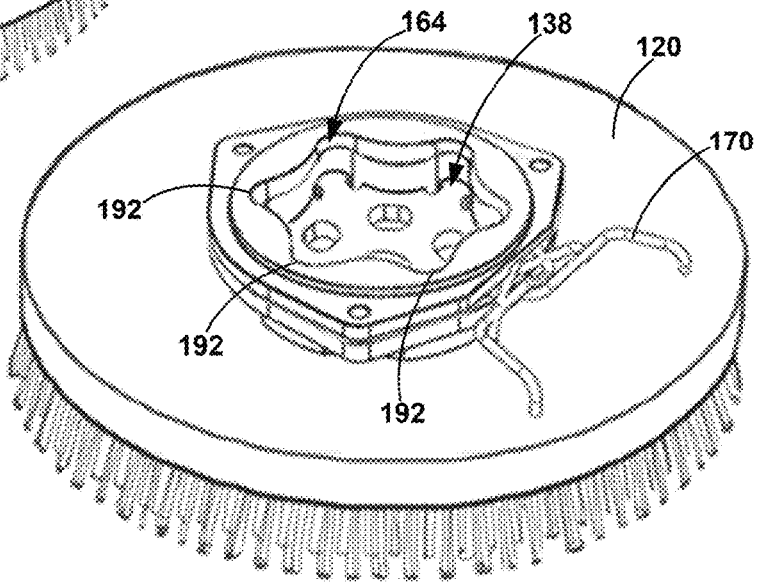

As best seen in FIG. 9, a portion of the aligning receptacle 160 can optionally have a chamfered surface 172 that tapers in a generally downwardly direction and oriented in a generally radially inwardly direction toward the receptacle axis 162. Of course, in other embodiments such as those illustrated in FIGS. 15A-C, the aligning receptacle 160 may not have a chamfered surface. Referring back to FIG. 9, the chamfered surface 172 can be formed by a portion of the receptacle opening 164 having a cross-sectional area that decreases gradually along the receptacle axis 162 in the generally downwardly direction when viewed from the front of the cleaning tool 120. The chamfered surface 172 can facilitate guiding and seating the hub 150 into the receptacle opening 164 and thereby engage the cleaning tool 120 to the driver 142 such that the receptacle axis 162 is coaxial with the rotational axis 154. For instance, the chamfered surface 172 can guide the hub 150 to follow the shape and contour of the chamfered surface 172 (e.g., radially inward and in a generally downwardly tapering direction when viewed from the top of the surface maintenance machine 100). This allows the hub 150 to slide into and be seated in the receptacle opening 164. In some cases, the aligning receptacle 160 is disc-shaped and a portion of the aligning receptacle 160 corresponding to the chamfered surface 172 has a frustoconical shape. In such cases, at least a portion of the hub 150 has a cross-sectional area that is less than the smallest cross-sectional area of the frustoconical portion 172 of the aligning receptacle 160 so that at least a portion of the hub 150 can be received by the aligning receptacle 160. In the illustrated embodiment, the entire hub cross-section is received and seated in the aligning receptacle 160. Additionally, the tool adapter interface 138 can be shaped such that its cross-sectional area corresponds with (e.g., approximately equal to) the smallest cross-sectional area of the frustoconical portion 172 of the aligning receptacle 160.

FIGS. 10 and 11 show certain embodiments of the tool adapter 130 with two different spring-loaded clips. In the embodiment illustrated in FIG. 10, the spring-loaded clip 170 has ends that extend longer than the ends of the spring-loaded clip 170 illustrated in FIG. 11. As described previously, the spring-loaded clip 170 is spring-biased to lock around the hub 150. For example, the spring-loaded clip 170 is spring-biased to remain in the position shown in FIGS. 10 and 11. When the operator pushes the cleaning tool 120 against a stationary hub 150 (or vice versa), the spring force of the spring-loaded clip 170 is overcome by the applied force, such that the spring-loaded clip 170 moves radially outwardly. Once the operator stops applying the applied force to overcome the spring force, the spring-loaded clip 170 returns to its locked state and moves radially inwardly, wherein it locks the hub 150 with the cleaning tool 120. As seen in FIGS. 10 and 11, in certain embodiments, the tool adapter 130 can have a plurality of projections 174 spaced along its surface 130A (e.g., along edge perimeter 180). As best seen in FIG. 7, at least one of the projections 174 has grooves 176 defined therein for holding the spring-loaded clip 170 against the spring force of the spring-loaded clip 170, substantially around the edge perimeter 180 of the tool adapter 130. For instance, as seen in FIG. 10, a pair of opposing projections 174 positioned radially opposite each other holds the spring-loaded clip 170 seated therein. In FIGS. 10 and 11, a first projection includes a groove so that the spring-loaded clip 170 can be seated in the first projection. However, the second projection can also have grooves 176 (e.g., on the lateral sides) so that the spring-loaded clip 170 can remain seated and held in tension.

With continued reference to FIGS. 10 and 11, in some cases, the tool adapter 130 includes a plurality stoppers 178 spaced proximal to the edge perimeter 180 of the tool adapter 130. The stoppers 178 can limit an extent of radially-outwardly directed extension of the spring-loaded clip 170 when the cleaning tool 120 is loaded to the surface maintenance machine 100. For instance, if an operator uses excessive force to push the cleaning tool 120 against the hub 150, the stoppers 178 ensure that the spring-loaded clip 170 is generally contained within the edge perimeter 180 of the tool adapter 130 and prevent the spring-loaded clip 170 from extending further (e.g., radially outwardly).

Figure 12B:
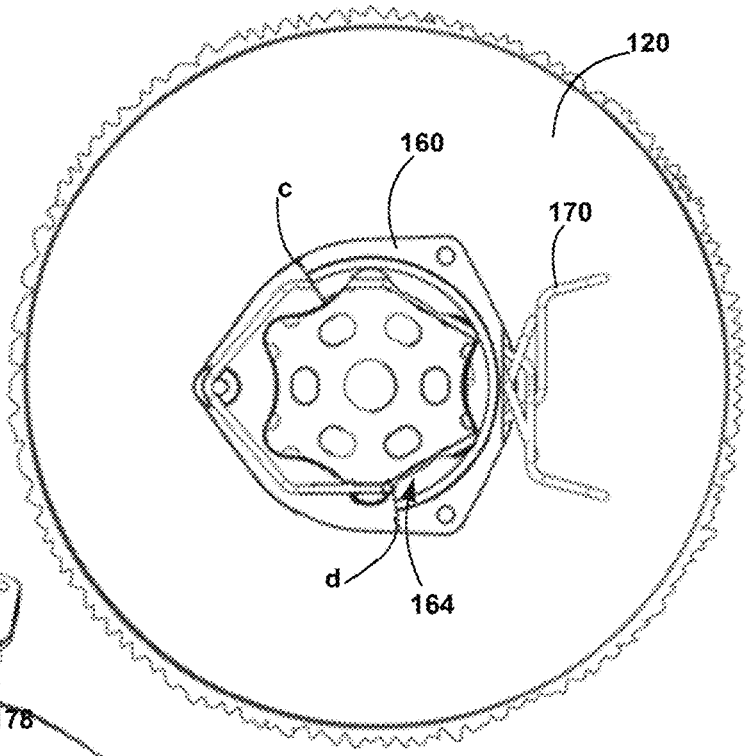
FIGS. 12A-C illustrate a front perspective and a top plan view of a cleaning tool with an aligning receptacle according to another embodiment.
Figure 12A:
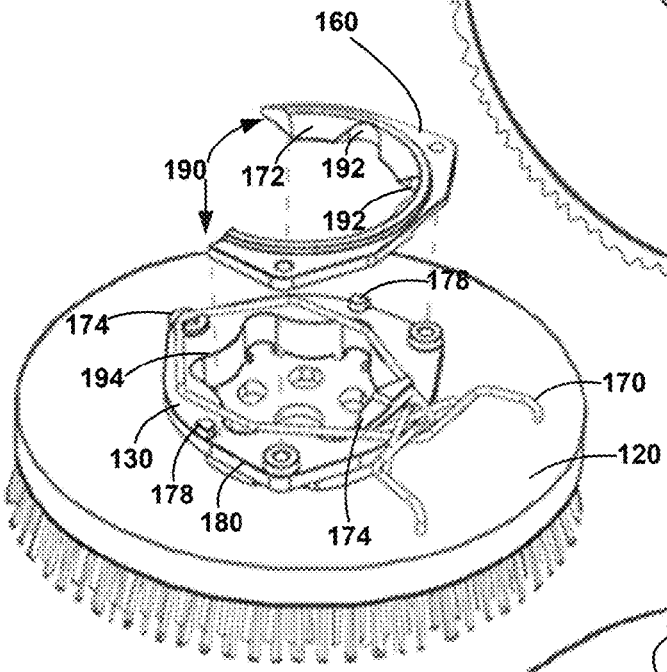
Figure 12C:
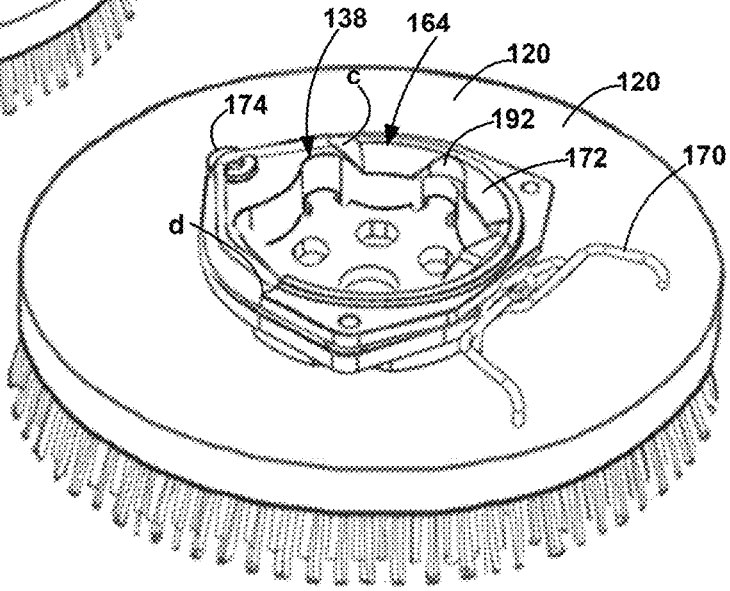

While the embodiments illustrated so far show a disc-shaped alignment receptacle optionally having a chamfered surface 172, the alignment receptacle can have other shapes or configurations. FIGS. 12A-17C illustrate various configurations of the alignment receptacle. As seen in FIG. 12A-C, the alignment receptacle can have a cut-off portion 190. In such cases, the alignment receptacle has three or more alignment recesses 192 defined along an edge perimeter 194 of the receptacle opening 164. The alignment recesses 192 can have a shape complementary to the hub 150 (e.g., star shaped recesses if the hub 150 is star shaped). The alignment recesses 192 guide and seat the hub 150 into the receptacle opening 164 and thereby engage the cleaning tool 120 to the driver 142 such that the cleaning tool 120 and the driver 142 are rotationally aligned and a rotational motion of the driver 142 is transferred to the cleaning tool 120 by the hub 150. Such embodiments can be beneficial if the cleaning tool 120 is to be loaded on to a surface maintenance machine 100 having a low clearance from a floor surface. For instance, an operator can slide the cleaning tool 120 and the alignment receptacle mounted thereon such that the cut-off portion 190 of the alignment receptacle slides under the surface maintenance machine 100 initially facilitating ease of loading the cleaning tool 120 to the surface maintenance machine 100.

Figure 13B:
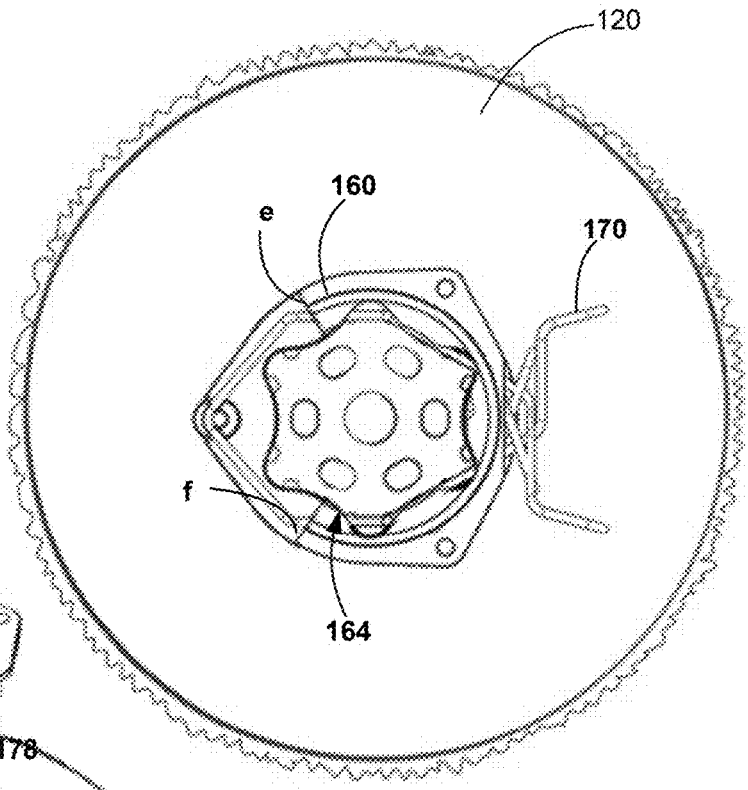
FIGS. 13A-C illustrate a front perspective and a top plan view of a cleaning tool with an aligning receptacle according to another embodiment.
Figure 13A:
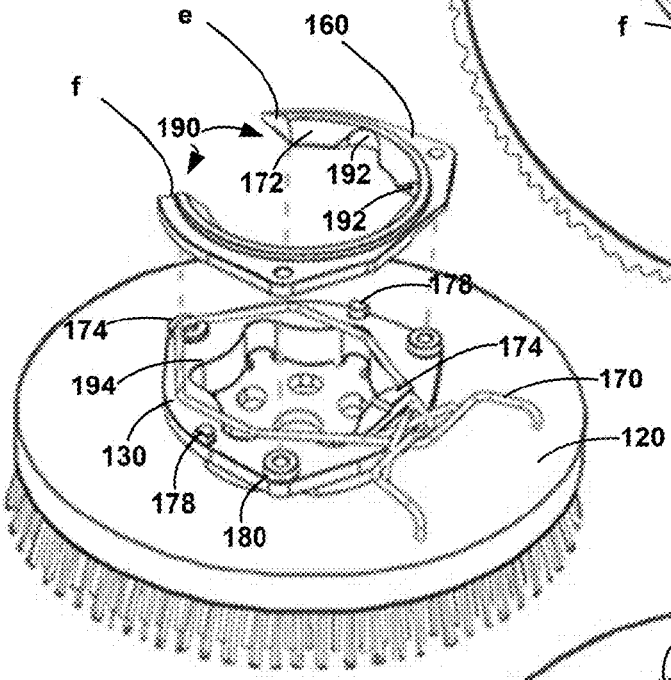
Figure 13C:
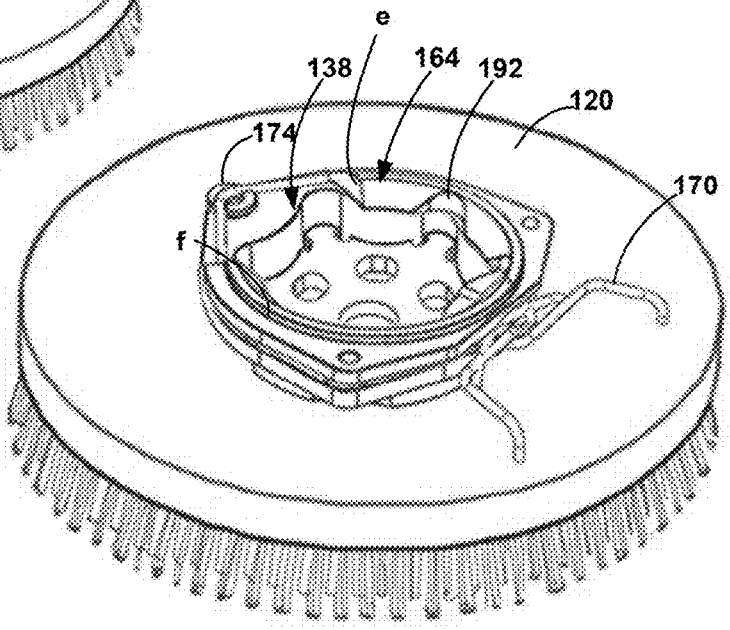

While three recesses are illustrated in FIGS. 12A-C, the aligning receptacle 160 can have greater or less than three recesses. For instance, FIGS. 13A-C illustrate an aligning receptacle 160 with four recesses. The aligning receptacle 160 shown in FIGS. 13A-13C, for instance, surrounds a greater portion of the edge perimeter 180 than the aligning receptacle 160 shown in FIGS. 12A-12C. For instance, in FIGS. 12A-12C, the ends 'c' and 'd' of the cut-off portion 190 are spaced further apart from each other than the distance by which ends 'e' and 'f' of the cut-off portion 190 shown in FIGS. 13A-13C are spaced apart from each other.

Figure 14B:
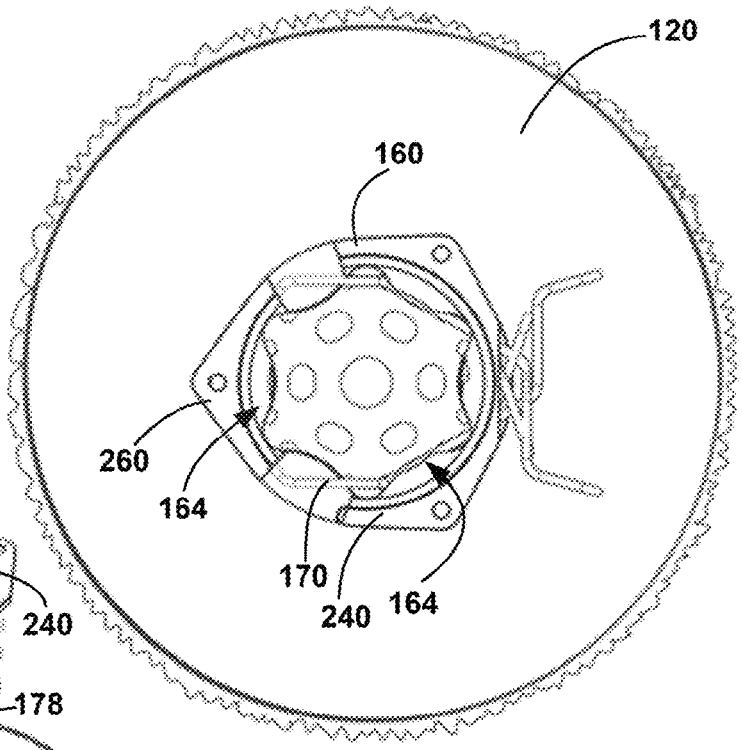
FIGS. 14A-C illustrate a front perspective and a top plan view of a cleaning tool with an aligning receptacle according to another embodiment.
Figure 14A:
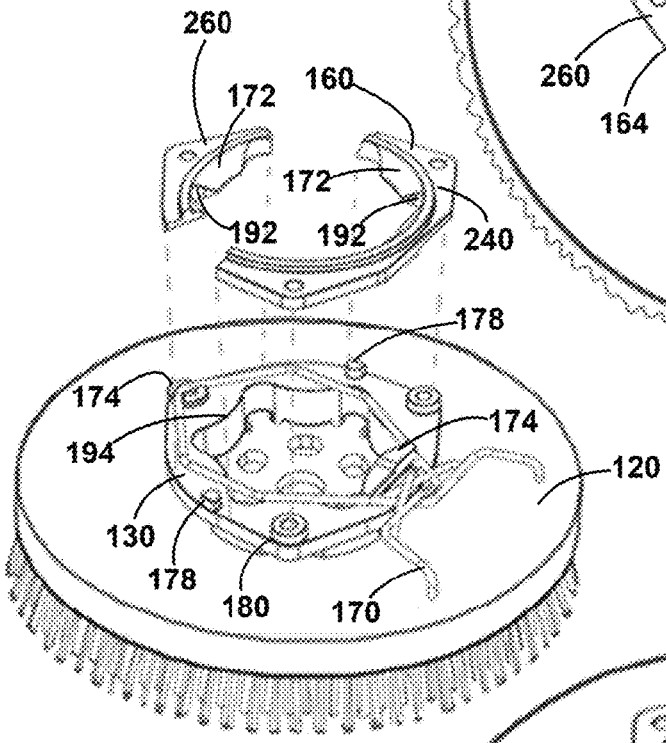
Figure 14C:
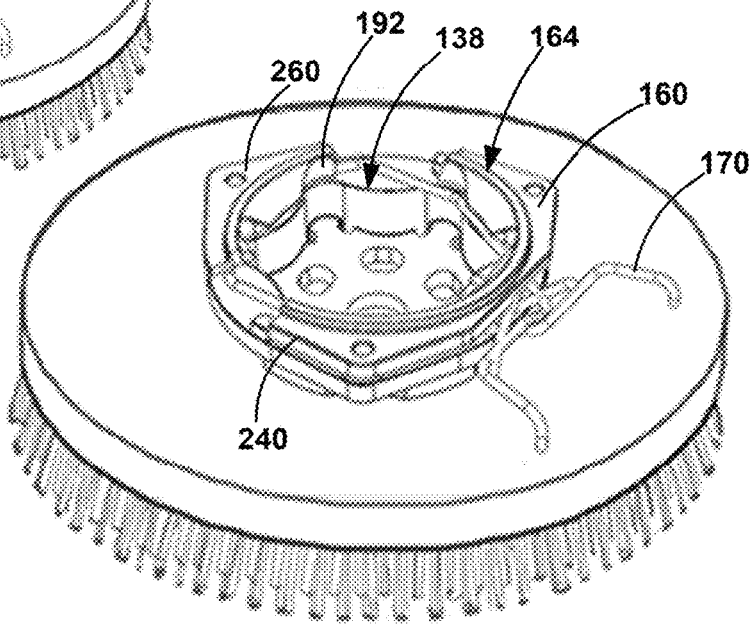

Instead of a single disc-shaped aligning receptacle 160, the cleaning tool 120 can be provided with a plurality of discs each having one or more aligning recesses as shown in FIG. 14A-C. For instance, the aligning receptacle 160 shown in FIG. 14A-14C includes a first disc 240 and a second disc 260. The first disc 240 can be substantially similar to the aligning receptacle 160 shown in FIG. 12A-12C, and surround a portion of the edge perimeter 180. The second disc 260 can surround another portion of the edge perimeter 180. The first and second discs 240, 260 can have several alignment recesses 192 to guide and seat the hub 150 into the receptacle opening 164 and thereby engage the cleaning tool 120 to the driver 142

FIGS. 16A-16C illustrate an aligning receptacle 160 according to another embodiment. In this embodiment, the aligning receptacle 160 is star shaped as illustrated in previous embodiments. However, unlike the embodiments illustrated previously, the aligning receptacle 160 shown in FIGS. 16A-16C has twelve teeth defined therein which provide additional aligning recesses 192 formed on the aligning receptacle 160. Additional or fewer teeth of the star shaped aligning receptacle 160 are also contemplated.

Figure 17B:
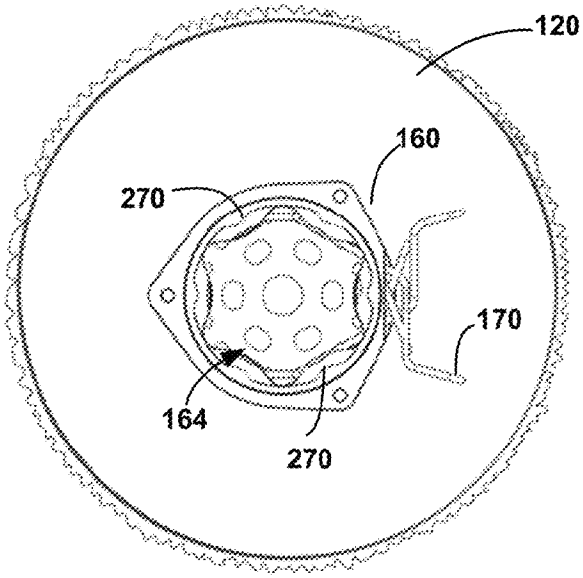
FIGS. 17A-C illustrate a front perspective and a top plan view of a cleaning tool with an aligning receptacle according to another embodiment.
Figure 17C:
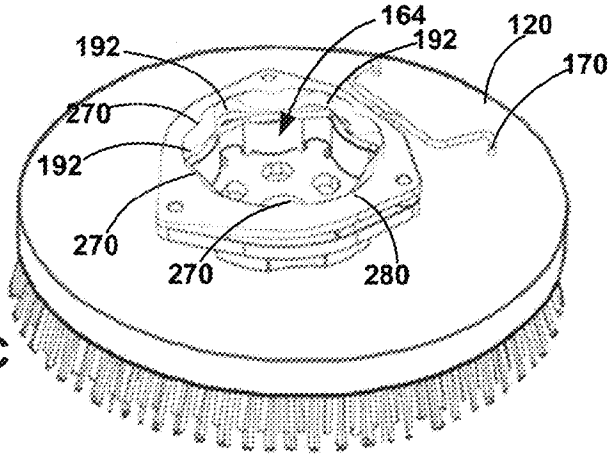
Figure 17A:
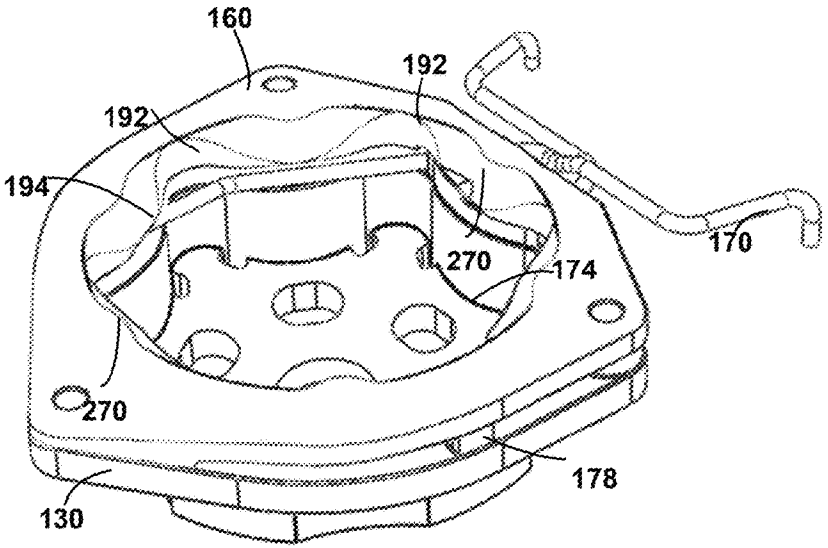

FIGS. 17A-17C illustrate an aligning receptacle 160 according to another embodiment. In this embodiment, the aligning receptacle 160 includes one or more ridges 270 defined between two alignment recesses 192 to further facilitate guiding and seating the hub 150 in the receptacle opening 164. The ridges 270 may project radially inwardly from a top surface 280 of the aligning receptacle 160, thereby providing tactile feedback when an operator attempts to guide and seat the hub 150 in the receptacle opening 164. The ridges 270 can extend along the entire thickness of the chamfered surface 172. In use, an operator may attempt engaging the cleaning tool 120 with the hub 150 by manipulating its rotational and axial orientation such that the hub 150 is received in the receptacle opening 164. In such cases, when the receptacle opening 164 is misaligned rotationally with respect to the hub 150, the ridge 270 abuts against the hub 150 signaling to the operator that a further rotation of the receptacle opening 164 (and consequently the cleaning tool 120) rotationally aligns the receptacle opening 164 to the hub 150.

Figure 18:
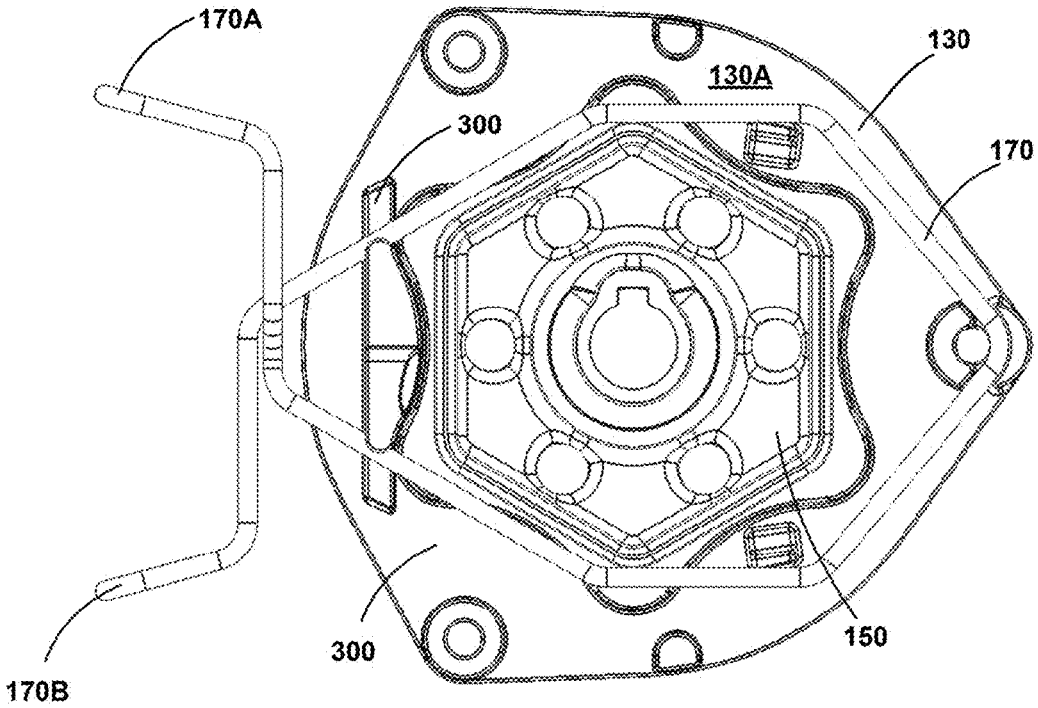
FIG. 18 is a top-plan view of a spring-loaded clip with the aligning receptacle hidden from view according to an embodiment.
Figure 19:
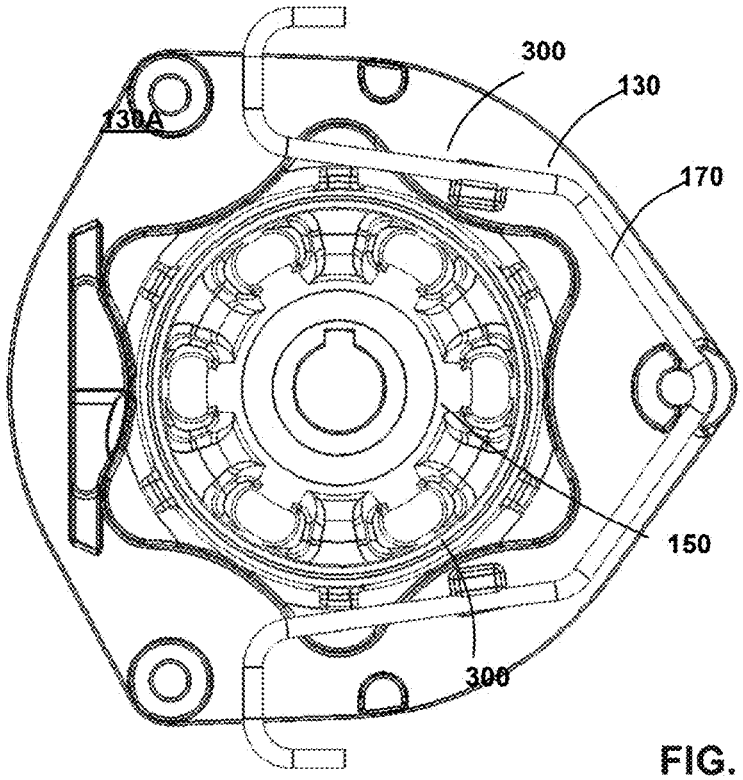
FIG. 19 is a top-plan view of a spring-loaded clip with the aligning receptacle hidden from view according to another embodiment.
Figure 20:
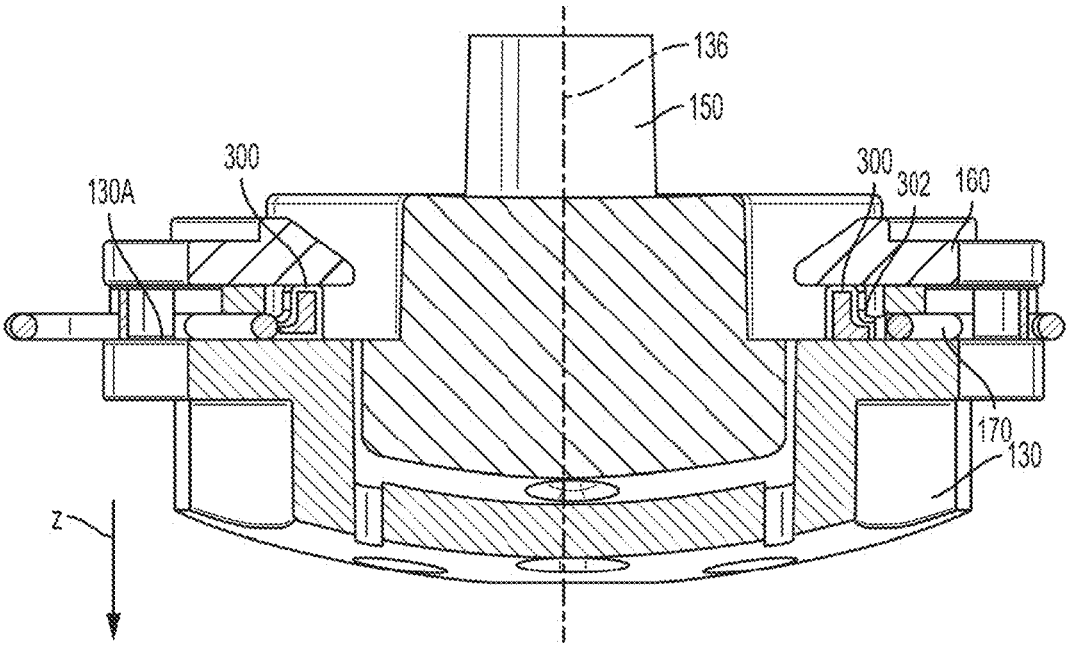
FIG. 20 is a cross-sectional view of the tool adapter of FIG. 19 taken along B-B with the spring-loaded clip in the preloaded position.
Figure 21:
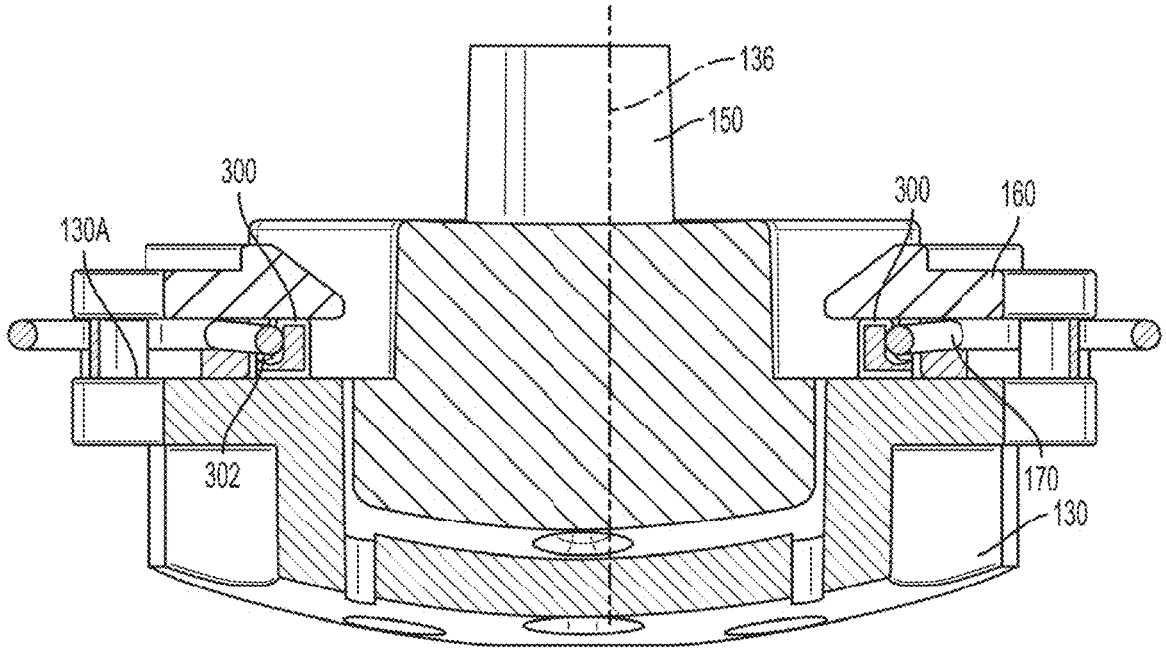
FIG. 21 is a cross-sectional view of the tool adapter of FIG. 19 taken along B-B with the spring-loaded clip in the locked position.

FIGS. 18-23 show various views of a hub 150 according to some embodiments. FIG. 18 illustrates a tool adapter with a spring loaded clip according to one embodiment and FIG. 19 shows the tool adapter with a spring loaded clip according to another embodiment. As described previously herein, the spring-loaded clip is spring-biased to a "locked position". The locked position is suitable for retaining the cleaning tool 120 on to the machine during transportation and/or use. During cleaning tool installation, an operator pushes the cleaning tool 120 from underneath the machine 100 vertically along hub axis 154 onto the hub 150, and overcomes the spring force of the spring-loaded clip 170 and thereby push it radially outward. Alternatively, the hub 150 is lowered toward the cleaning tool 120, and a force is applied thereon associated with the movement of the hub 150 toward a stationary cleaning tool 120. In some embodiments, the spring-loaded clip 170 can be moved radially outwardly by pinching the ends 170A and 170. However, doing so can be cumbersome due to limited floor clearance and access available to an operator under the machine. Accordingly, the tool 120 is moved upwardly toward a stationary hub 150, or the hub 150 is lowered toward a stationary tool 120. In either case, an applied force associated with the movement of the hub 150 and the cleaning tool 120 toward each other is used to overcome the spring force of the spring-loaded clip 170. The tool adapter 130 receives (e.g., aligns rotationally and axially) the hub 150 in the tool adapter 130 receptacle, after which because of the spring-biasing toward the locked position, the spring-loaded clip 170 grasps the hub 150 by moving radially inwardly, and locks the cleaning tool 120 to the machine 100. As will be appreciated by one skilled in the art, such a process can be time-consuming and cumbersome to an operator. Accordingly, in the embodiments illustrated in FIGS. 18-23, the spring-loaded clip 170 is preloaded to lower the applied force for overcoming spring force of the spring-loaded clip. In such cases, the spring force is overcome by the applied force associated with the movement of the hub 150 and the cleaning tool 120 and/or a weight of the cleaning tool 120. The spring force of the spring-loaded clip 170 can be lower in the preloaded position than in the locked position, such that a lower applied force is sufficient to overcome the spring force when the spring-loaded clip 170 is the pre-loaded position.

With continued reference to FIGS. 18 and 19, the tool adapter 130 is provided with one or more lock-out tabs 300 on surface 130A of the tool adapter interface 138 for temporarily holding the spring-loaded clip 170 in a pre-loaded position prior to loading the cleaning tool 120 on to the machine 100. The lock-out tabs 300 can have a stair-step profile when viewed from the side (e.g., laterally with respect to the tool adapter axis 136). For example, the lock-out tabs 300 can have a first elevated surface 302 disposed at a first height above a major surface 130A of the tool adapter 130. As shown in the cross-sectional view of FIG. 20, the spring-loaded clip 170 is substantially in contact (e.g., flush) against the major surface of the tool adapter 130 in the pre-loaded position. In this position, the spring-loaded clip 170 has a partial overlap (shown by the dashed line of FIG. 22) against the tool adapter 130 opening 152, at locations indicated by arrows "x" and "y". The spring-loaded clip 170 extends substantially outside of the tool adapter interface 138 except at the overlap locations "x" and "y".

Figure 22:
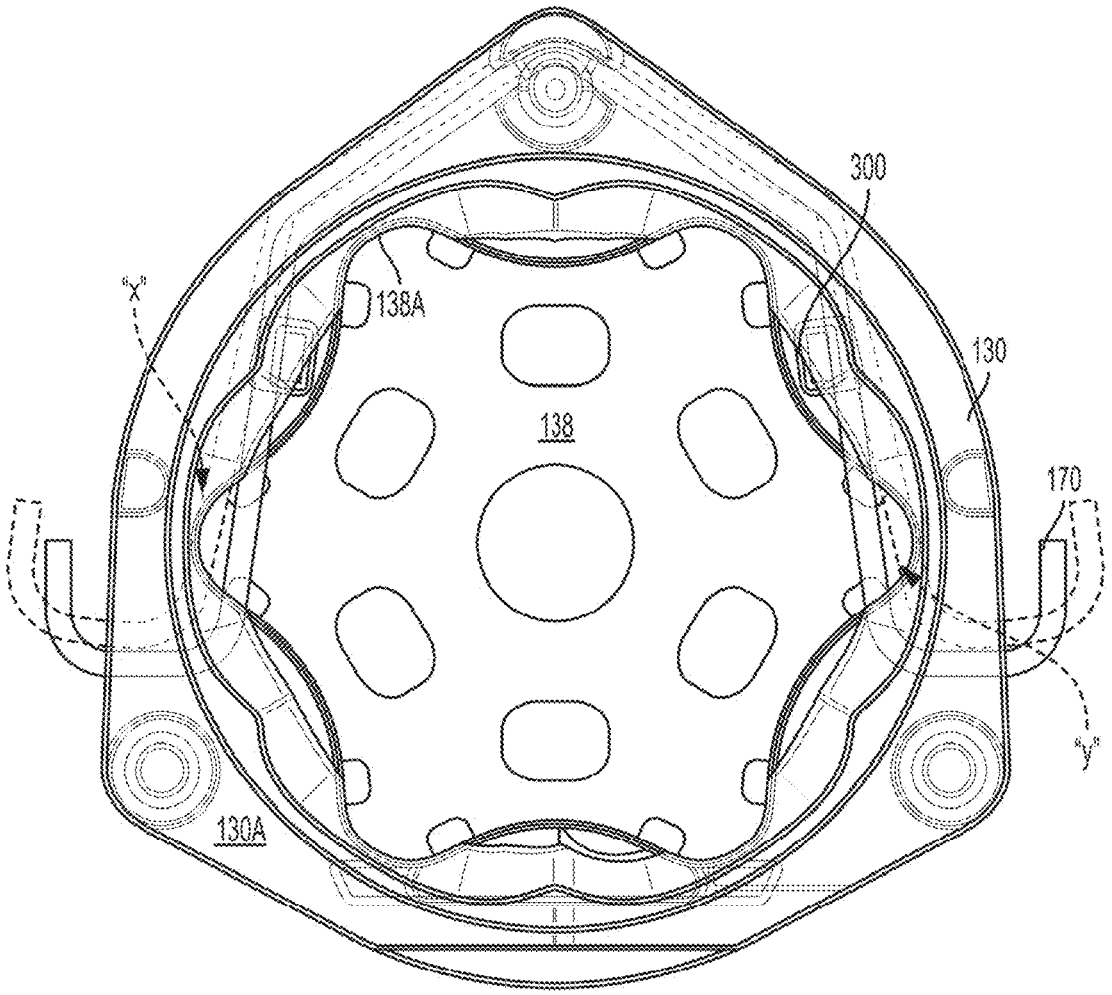
FIG. 22 is a top-plan view of the tool adapter of FIG. 19 with the spring-loaded clip shown in locked (solid lines) and pre-loaded position (dashed lines)
Figure 23:
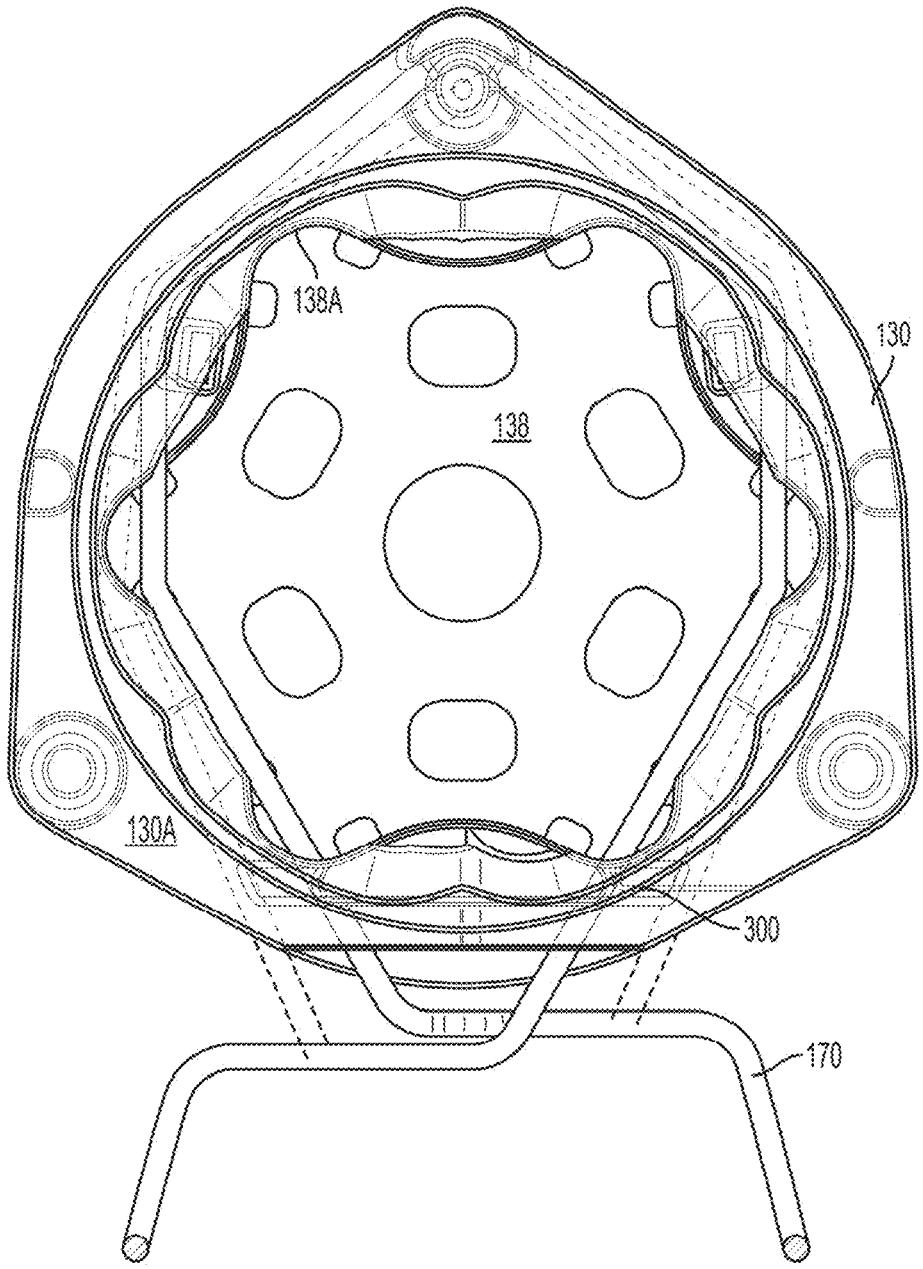
FIG. 23 is a top-plan view of the tool adapter of FIG. 18 with the spring-loaded clip shown in both locked (solid lines) and pre-loaded (dashed lines) positions.

Referring now to FIGS. 22 and 23, when the cleaning tool 120 is pushed against the hub 150 (not shown in FIGS. 22 and 23 for clarity), or when the hub 150 is lowered toward the tool adapter 130, the tool adapter 130 receives the hub 150, as is the case without the lock-out tabs 300. However, the overlap against the tool adapter interface 138 of the spring-loaded clip 170 when held in the pre-loaded position is less than the overlap against the tool adapter interface 138 in embodiments without the lock-out tabs 300. The overlap of the spring-loaded clip 170 and the tool adapter interface 138 without the lock-out tabs 300 can be substantially same as the overlap of the spring-loaded clip 170 with the tool adapter interface 138 in the locked position of embodiments with the lock-out tabs 300. As a result of the lower overlap against the tool adapter interface 138 in the pre-loaded position, an operator has less spring biasing to overcome than when there are no lock-out tabs 300. The spring biasing of the spring-loaded clip 170, for instance can be lower in the pre-loaded position than in the fully locked position. This lower spring-force in the preloaded position results in less pushing force required from the operator when loading the cleaning tool 120 on to the machine thereby facilitating ease of loading/installing the cleaning tool 120.

Once the hub 150 is lowered on to the tool adapter 130 opening 152, portions of the hub 150 (e.g., lugs 150A and 150B shown in FIGS. 8 and 9) can abut against and/or grasp the pre-loaded clip 170 at locations "x" and "y", and pull the spring-loaded clip 170 radially inwardly, and away from the major surface 130A of the tool adapter 130 to grasp the hub 150 because of the spring-loaded clip 170 being spring-biased toward the locked position. As a result, the spring-loaded clip 170 moves in a direction from the pre-loaded position shown in FIG. 20 to the locked position in FIG. 21, wherein the hub 150 is secured to the cleaning tool 120. While lugs 150A and 150B are illustrated as being upright, they can have chamfered portions tapering downwardly toward the spring-loaded clip 170. At the same time, the weight of the cleaning tool 120 acting in a generally downward direction "z" pulls the spring-loaded clip 170 such that the spring-loaded clip 170 rests at the first elevated surface 302 of the lock-out tabs 300. The spring-loaded clip 170 therefore moves away from the major surface 130A and radially inwardly when the spring-loaded clip 170 moves from the preloaded position to the locked position. The spring-loaded clip 170 extends in the locked position around the hub 150 and overlaps a greater extent against the tool adapter 130 opening 152 as shown in FIG. 22 than in the preloaded position shown by dashed lines in FIG. 22. The overlap of the spring-loaded clip 170 in the locked position can be generally same as its overlap in embodiments without the lockout tabs 300.

Referring back to FIGS. 18 and 19, the lock-out tabs 300 can be positioned at any location on surface 130A. For example, in the case of the spring-loaded clip 170 shown in FIG. 18, the lock-out tabs 300 are position closer to the bottom of the tool adapter 130, whereas for the spring-loaded clip 170 of FIG. 19, the lock-out tabs 300 are positioned proximal to the bent portion of the spring-loaded clip 170 at the top of the tool adapter 130. Any other location, consistent with the length of the spring loaded clip can be chosen. Similarly, the shape, dimensions and number of lock-out tabs 300 can be chosen by those skilled in the art based on the desired amount of force to be applied by the operator against the spring force, size of the cleaning tool 120, ease of manufacturing, among other factors. While a pair of lockout tabs 300 is illustrated, a single lockout tab 300 can be used. Additional lockout tabs 300 are also contemplated. Additionally, the lock-out tabs can be used in combination with or without the aligning receptacles shown herein.

In use, an operator can slide the cleaning tool 120 with the aligning receptacle 160 toward a bottom surface of the surface maintenance machine 100 and proximal to the hub 150. The operator can apply a pushing force directed generally upwardly when viewed from the front of the surface maintenance machine 100. Alternatively, the hub 150 can be lowered toward a stationary cleaning tool 120. The aligning receptacle 160 self-centers and seats the hub 150 and/or cleaning tool 120 in the receptacle opening 164 such that the hub 150 is positioned concentrically in the tool adapter 130 when the cleaning tool 120 is loaded to the surface maintenance machine 100. The aligning receptacle 160 additionally circumferentially aligns the hub 150 with the aligning receptacle 160 such that the aligning recesses matingly engage with the lugs of the hub 150. The spring-loaded clip 170 expands radially outwardly when the operator pushes the cleaning tool 120, and retracts radially inwardly and clamps the hub 150 in the aligning receptacle 160, thereby mechanically coupling the cleaning tool 120 to the hub 150 and in turn, to the driver 142. Optionally, an operator can pre-load the spring-loaded clip 170 as described herein prior to loading the cleaning tool 120 to the machine 100. Once loaded, the weight of the cleaning tool 120 pulls the spring-loaded clip 170 from the pre-loaded position to the locked position, thereby grasping the hub 150 and securing the cleaning tool 120 to the machine 100. The operator can release the cleaning tool 120 from the machine 100 by either pinching the ends 170A of the spring-loaded clip 170 if the operator can reach them (e.g., spring-loaded clip 170 shown in FIG. 18) or by using other means (e.g., a foot pedal and a release mechanism) for spring-loaded clip 170 shown in FIG. 19 if the cleaning tool 120 is to be removed or replaced. Additionally, the aligning recesses and/or ridges can provide tactile feedback to the user if the cleaning tool is axially and/or rotationally misaligned with respect to the hub, thereby indicating the operator to manually adjust the axial and/or rotational alignment of the tool with respect to the hub.

Embodiments of cleaning tools with a quick alignment mechanism disclosed herein allow for ease of access especially in floor cleaning machines having a low clearance between the bottom surface of the surface maintenance machine 100 and the floor surface. Floor cleaning machines with low clearance can render visual inspection of the cleaning head assembly difficult. However, the aligning receptacle self-centers and seats the cleaning tool to the hub, eliminating the need for the operator to visually inspect the cleaning head assembly when loading the cleaning tool, resulting in one-handed operation and quick loading and unloading of the cleaning tool.

Thus, embodiments of the surface maintenance machine with a quick alignment mechanism are disclosed. Although the present disclosure has been described in considerable detail with reference to certain disclosed embodiments, the disclosed embodiments are presented for purposes of illustration and not limitation and other embodiments of the disclosure are possible. One skilled in the art will appreciate that various changes, adaptations, and modifications may be made.

What is claimed is:

1. A cleaning tool connector assembly for connecting a cleaning tool to a surface maintenance machine positioned on a floor surface, the cleaning tool connector assembly comprising:

a tool adapter for releasably engaging the cleaning tool with the surface maintenance machine, the tool adapter having a tool adapter interface, the tool adapter being releasably connectable to a hub of the surface maintenance machine, the tool adapter interface being of complementary shape to the hub such that the tool adapter has one or more predetermined relative rotational orientations in which the tool adapter is engageable with the hub to interlock the rotation of the hub with the tool adapter; and a spring-loaded clip positioned on the tool adapter, the spring-loaded clip being movable between a pre-loaded position and a locked position, the tool adapter being configured to temporarily hold the spring-loaded clip in the pre-loaded position prior to securing the tool adapter to the hub, the spring-loaded clip being spring-biased to move in a direction from the pre-loaded position to the locked position; and the engagement of the tool adapter and the hub causing the spring-loaded clip to release the temporary hold thereby permitting the spring-loaded clip to move from the pre-loaded position to the locked position, whereby the locked position maintains the engagement of the tool adapter and the hub.

2. The cleaning tool connector assembly of claim 1, wherein the tool adapter comprises one or more lockout tabs extending from a first surface of the tool adapter, each of the one or more lockout tabs having at least one elevated surface positioned above the first surface of the tool adapter.

3. The cleaning tool connector assembly of claim 2, wherein, the spring-loaded clip rests against the first surface of the tool adapter in the pre-loaded position, and the spring-loaded clip rests against the at least one elevated surface of a lockout tab of the one or more lockout tabs in the locked position.

4. The cleaning tool connector assembly of claim 1, wherein the spring-loaded clip is moved from the pre-loaded position to the locked position by a pushing force applied against the spring-loaded clip or a weight of the cleaning tool.

5. The cleaning tool connector assembly of claim 2, wherein the spring-loaded clip expands radially outwardly away from a tool adapter axis when loading the cleaning tool to the surface maintenance machine and contracts radially inwardly toward the tool adapter axis when the cleaning tool is loaded, the radially-inwardly directed contraction of the spring-loaded clip configured to lock the tool adapter to the hub and thereby hold the cleaning tool in place in the surface maintenance machine.

6. The cleaning tool connector assembly of claim 5, further comprising a plurality of projections spaced along an edge perimeter of the tool adapter, each projection having grooves defined therein for holding the spring-loaded clip in tension substantially around the edge perimeter of the tool adapter.

7. The cleaning tool connector assembly of claim 6, further comprising a plurality stoppers spaced along the first surface of the tool adapter, each stopper being configured to limit an extent of radially-outwardly directed extension of the spring-loaded clip when the cleaning tool is loaded to the surface maintenance machine.

8. The cleaning tool connector assembly of claim 5, wherein the spring-loaded clip terminates in a first end and a second end, the first end and the second end being positioned on opposite sides of the tool adapter axis.

9. The cleaning tool connector assembly of claim 1, wherein the spring-loaded clip extends radially into the tool adapter interface when the cleaning tool is not loaded.

10. The cleaning tool connector assembly of claim 1, wherein the tool adapter allows interchangeable connection of the cleaning tool, wherein the cleaning tool is one of a sweeping brush, a scrubbing brush, a pad driver for scrubbing, polishing, stripping and burnishing concrete or hard surfaces comprising mastic and resin.

11. The cleaning tool connector assembly of claim 1, wherein the spring-loaded clip has a spring force that opposes an applied force associated with the movement of the hub and the cleaning tool toward each other during engagement, the spring force being lower in the pre-loaded position than in the locked position for facilitating installation of the cleaning tool to the hub.

12. The cleaning tool connector assembly of claim 2, wherein the spring-loaded clip extends substantially outside of a perimeter surrounding the tool adapter interface except at one or more overlap locations in the pre-loaded position.

13. The cleaning tool connector assembly of claim 12, wherein when the spring-loaded clip is in the pre-loaded position, the spring-loaded clip abuts portions of the hub near at least one of the one or more overlap locations.

14. The cleaning tool connector assembly of claim 13, wherein, when the tool adapter interface engages with the hub, the spring-loaded clip is pulled by portions of the hub such that the spring-loaded clip is moved from the first surface of the tool adapter and on to the at least one elevated surface of a lockout tab of the one or more lockout tabs.

* * * * *